US008427415B2

(12) United States Patent
Morita

(10) Patent No.: US 8,427,415 B2
(45) Date of Patent: Apr. 23, 2013

(54) SOURCE DRIVER, ELECTRO-OPTICAL DEVICE, PROJECTION-TYPE DISPLAY DEVICE, AND ELECTRONIC INSTRUMENT

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 1354 days.

(21) Appl. No.: 12/071,374

(22) Filed: Feb. 20, 2008

(65) Prior Publication Data

US 2008/0204439 A1 Aug. 28, 2008

(30) Foreign Application Priority Data

Feb. 23, 2007 (JP) ..... 2007-043309
Feb. 23, 2007 (JP) ..... 2007-043310
Dec. 19, 2007 (JP) ..... 2007-327196
Dec. 19, 2007 (JP) ..... 2007-327197

(51) Int. Cl.
*G09G 5/00* (2006.01)

(52) U.S. Cl.
USPC ..... 345/100; 345/98; 345/690

(58) Field of Classification Search ..... 345/89, 345/204, 208–212, 690, 98, 99, 100
See application file for complete search history.

(56) References Cited

U.S. PATENT DOCUMENTS 5,940,058 A * 8/1999 Koyama ..... 345/89
6,151,005 A 11/2000 Takita et al.
6,366,065 B1 4/2002 Morita
7,046,223 B2 5/2006 Hashimoto
7,079,127 B2 7/2006 Morita
7,477,227 B2 1/2009 Hashimoto
2002/0145408 A1 10/2002 Morita
2002/0145600 A1 10/2002 Morita
2006/0202929 A1 * 9/2006 Baum et al. ..... 345/89

FOREIGN PATENT DOCUMENTS

JP A-06-348236 12/1994
JP A-07-306660 11/1995
JP A-2001-188615 7/2001
JP A-2002-215108 7/2002
JP A-2003-233355 8/2003

* cited by examiner

*Primary Examiner* — Amare Mengistu
*Assistant Examiner* — Jennifer Zubajlo
(74) *Attorney, Agent, or Firm* — Oliff & Berridge, PLC

(57) ABSTRACT

A source driver includes P grayscale signal lines, a corresponding grayscale voltage being supplied to each of the P grayscale signal lines, Q switch signal lines, a corresponding grayscale voltage being supplied to each of the Q switch signal lines, a first DAC that outputs a grayscale voltage among P grayscale voltages supplied to the P grayscale signal lines based on grayscale data, a second DAC that outputs a grayscale voltage among Q grayscale voltages supplied to the Q switch signal lines based on the grayscale data, and a source line driver section that drives a source line based on an output from the first DAC or the second DAC. The source line driver section generates a second drive signal of the source line based on the output from the second DAC, and then generates a first drive signal of the source line based on the output from the first DAC within one horizontal scan period.

19 Claims, 31 Drawing Sheets

FIG. 8A POSITIVE
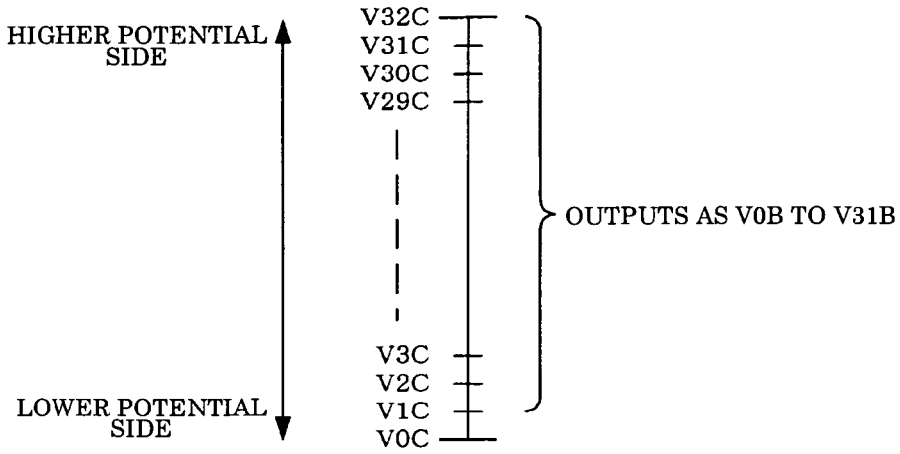
FIG. 8B NEGATIVE
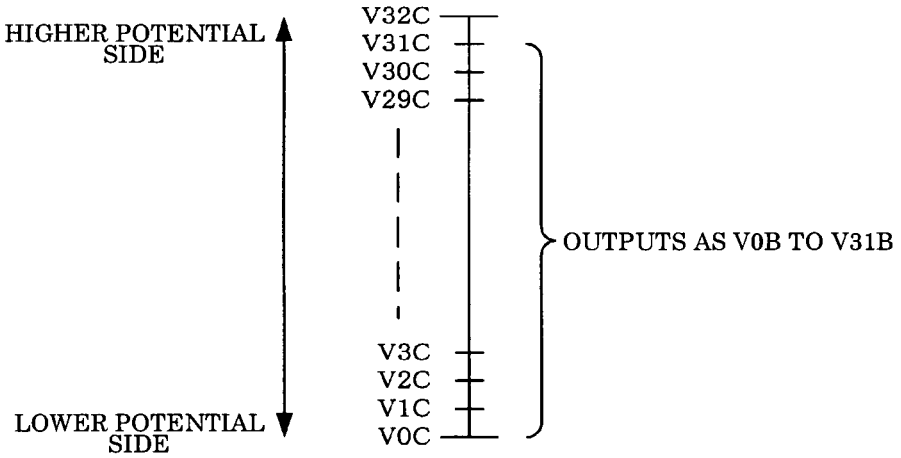

SOURCE DRIVER, ELECTRO-OPTICAL DEVICE, PROJECTION-TYPE DISPLAY DEVICE, AND ELECTRONIC INSTRUMENT

Japanese Patent Application No. 2007-43309 filed on Feb. 23, 2007, Japanese Patent Application No. 2007-43310 filed on Feb. 23, 2007, Japanese Patent Application No. 2007-327196 filed on Dec. 19, 2007, and Japanese Patent Application No. 2007-327197 filed on Dec. 19, 2007, are hereby incorporated by reference in their entirety.

BACKGROUND OF THE INVENTION

The present invention relates to a source driver, an electro-optical device, a projection-type display device, an electronic instrument, and the like.

As a liquid crystal panel (electro-optical device) used for electronic instruments such as a portable telephone or a projection-type display device, an active matrix type liquid crystal panel using a switching device such as a thin film transistor (hereinafter abbreviated as "TFT") have been known.

It has been considered that it is difficult to reduce power consumption when employing the active matrix type liquid crystal panel for portable electronic instrument such as a portable telephone. In recent years, the power consumption of the active matrix type liquid crystal panel has been sufficiently reduced. The active matrix type liquid crystal panel has attracted attention in that the active matrix type liquid crystal panel is suitable for increasing the number of colors and displaying a video image.

In general, gamma correction is performed for a drive signal of a display device corresponding to the grayscale characteristics of the display device in order to achieve an accurate image display. Taking a liquid crystal device as an example, a grayscale voltage which is gamma-corrected so that an optimum pixel transmissivity is implemented is output based on grayscale data for grayscale display. A source line is driven based on the grayscale voltage.

In recent years, an increase in image quality of a display image has been increasingly desired. Therefore, an increase in the number of grayscales has been desired for a source driver which drives a source line of an electro-optical device. In this case, it is necessary to supply a larger number of types of grayscale voltages to each output buffer which drives each source line of the electro-optical device.

The screen size and the definition of a liquid crystal panel have been increased. Therefore, the number of pixels (number of dots) per scan line has been significantly increased. This makes it necessary to apply a grayscale voltage selected from a plurality of grayscale voltages to each pixel within one horizontal scan period.

However, since the horizontal scan period has been increasingly reduced, it is difficult to apply a voltage at a desired potential to each pixel within a specified period of time. Therefore, it is difficult to produce a source driver which implements high grayscale accuracy.

In a liquid crystal panel, the voltage supplied to the source line is changed in a given cycle by polarity inversion drive in order to prevent a situation in which a direct-current component is applied to the pixel (liquid crystal) for long period of period. The period of time required for the voltage level to become stable (converge) increases as the change in voltage increases. This further makes it difficult to achieve high grayscale accuracy.

JP-A-7-306660 discloses technology in which stepwise voltages are generated in order to reduce the number of grayscale voltage signal lines, and a pulse width modulation signal is generated by sampling a desired voltage from a plurality of stepwise voltages to express halftone. However, grayscale representation is limited to the pulse-width modulation method. Moreover, it is difficult to increase the image quality when a larger number of grayscales is required.

It is also difficult to set the levels of all of the stepwise voltages with high accuracy. Even if the voltage level can be set with high accuracy, the circuit becomes complicated. In particular, it becomes difficult to generate the stepwise voltages of which the levels are set with high accuracy, as disclosed in JP-A-7-306660, as the number of grayscales increases so that the difference in voltage between the grayscales decreases.

A high-definition image display with an increased number of grayscales is also desired for a projection-type display device.

SUMMARY

According to one aspect of the invention, there is provided a source driver that drives a source line of an electro-optical device based on grayscale data, the source driver comprising:

P grayscale signal lines, P being a positive integer equal to or larger than two, a corresponding grayscale voltage being supplied to each of the P grayscale signal lines;

Q switch signal lines, Q being a positive integer equal to or smaller than P, a corresponding grayscale voltage being supplied to each of the Q switch signal lines;

a first DAC that outputs a grayscale voltage among P grayscale voltages that are supplied to the P grayscale signal lines based on the grayscale data;

a second DAC that outputs a grayscale voltage among Q grayscale voltages that are supplied to the Q switch signal lines based on the grayscale data; and a source line driver section that drives the source line based on an output from the first DAC or the second DAC, the source line driver section generating a second drive signal of the source line based on the output from the second DAC, and then generating a first drive signal of the source line based on the output from the first DAC within one horizontal scan period.

According to another aspect of the invention, there is provided a source driver that drives a source line of an electro-optical device based on grayscale data, the source driver comprising:

P grayscale signal lines, P being a positive integer equal to or larger than two, a corresponding grayscale signal being supplied to each of the P grayscale signal lines;

Q switch signal lines, Q being a positive integer equal to or smaller than P, a corresponding grayscale signal being supplied to each of the Q switch signal lines;

a first DAC that outputs a grayscale signal among the P grayscale signals supplied to the P grayscale signal lines based on the grayscale data;

a second DAC that outputs a grayscale signal among the Q grayscale signals supplied to the Q switch signal lines based on the grayscale data; and a source line driver section that drives the source line based on an output from the first DAC or the second DAC, the source line driver section generating a second drive signal of the source line based on the output from the second DAC, and then generating a first drive signal of the source line based on the output from the first DAC within one horizontal scan period.

According to another aspect of the invention, there is provided an electro-optical device comprising one of the above source drivers.

According to another aspect of the invention, there is provided a projection-type display device comprising one of the above source drivers.

According to another aspect of the invention, there is provided an electronic instrument comprising one of the above source drivers.

BRIEF DESCRIPTION OF THE SEVERAL VIEWS OF THE DRAWING

FIGS. 8A and 8B are views illustrative of the operation of a switch voltage select circuit shown in FIG. 6.

DETAILED DESCRIPTION OF THE EMBODIMENT

Figure 1:
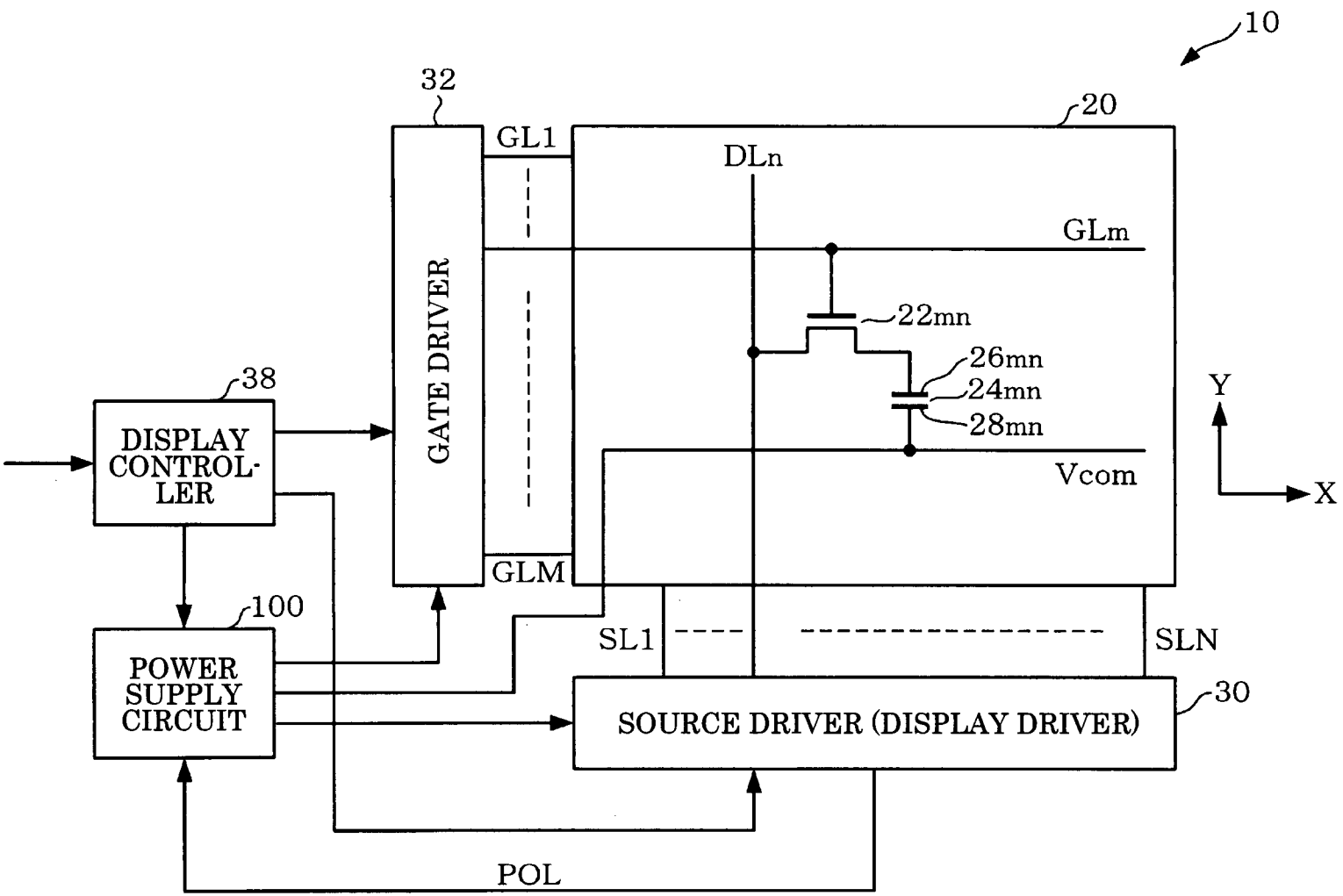
FIG. 1 is a view showing an outline of the configuration of a liquid crystal device according to one embodiment of the invention.

Some aspects of the invention may provide a source driver which can achieve high grayscale accuracy even if the number of grayscales increases, an electro-optical device, a projection-type display device, and an electronic instrument.

Further aspects of the invention may provide a source driver which can achieve high grayscale accuracy with an increased number of grayscales when polarity inversion drive is performed, an electro-optical device, a projection-type display device, and an electronic instrument.

According to one embodiment of the invention, there is provided a source driver that drives a source line of an electro-optical device based on grayscale data, the source driver comprising:

P grayscale signal lines, P being a positive integer equal to or larger than two, a corresponding grayscale voltage being supplied to each of the P grayscale signal lines;

Q switch signal lines, Q being a positive integer equal to or smaller than P, a corresponding grayscale voltage being supplied to each of the Q switch signal lines;

a first DAC that outputs a grayscale voltage among P grayscale voltages that are supplied to the P grayscale signal lines based on the grayscale data;

a second DAC that outputs a grayscale voltage among Q grayscale voltages that are supplied to the Q switch signal lines based on the grayscale data; and a source line driver section that drives the source line based on an output from the first DAC or the second DAC, the source line driver section generating a second drive signal of the source line based on the output from the second DAC, and then generating a first drive signal of the source line based on the output from the first DAC within one horizontal scan period.

According to this embodiment, the voltage of the grayscale signal line is supplied to the input of the source line driver circuit after the voltage of the impact-absorption switch signal line has been supplied to the input of the source line driver section. Therefore, a change in voltage when changing the grayscale voltage is reduced by repeatedly performing capacitance division between the parasitic capacitance of the input of the output circuit and the parasitic capacitance of the signal line. According to this embodiment, even when changing the grayscale voltage by polarity inversion drive or the like, the voltage of the grayscale signal line does not change, whereby the voltage at a stable potential can be supplied to the source line driver section. Therefore, a source driver which implements high grayscale accuracy can be provided.

The source driver may further comprise a switch voltage select circuit that outputs the Q grayscale voltages among at least (Q+1) grayscale voltages based on a polarity of a voltage applied to an electro-optical substance, a voltage of the source line being applied to the electro-optical substance.

In the source driver, the polarity may be a polarity of a voltage applied to the electro-optical substance that is sealed between a pixel electrode that is provided with the voltage of the source line and a common electrode that is provided opposite to the pixel electrode.

According to this embodiment, since the voltage of the switch signal line is set corresponding to the polarity of the voltage applied to a liquid crystal, the voltage of the input node of the source line driver section can be quickly set by causing the voltage to change steeply. This makes it possible to further stabilize the voltage of the source line, whereby higher grayscale accuracy can be achieved.

In the source driver, when the switch voltage select circuit outputs the Q grayscale voltages from the (Q+1) grayscale voltages, the switch voltage select circuit may output the Q grayscale voltages among the (Q+1) grayscale voltages excluding a grayscale voltage at the lowest potential when the polarity is positive.

According to this embodiment, since the voltages of the switch signal lines set on the higher potential side are supplied when the polarity of the voltage applied to the liquid crystal is positive, the voltage of the input node of the source line driver section can be quickly set by causing the voltage to rise steeply. This makes it possible to further stabilize the voltage of the source line, whereby higher grayscale accuracy can be achieved.

In the source driver, when the switch voltage select circuit outputs the Q grayscale voltages from the (Q+1) grayscale voltages, the switch voltage select circuit may output the Q grayscale voltages among the (Q+1) grayscale voltages excluding a grayscale voltage at the highest potential when the polarity is negative.

According to this embodiment, since the voltages of the switch signal lines set on the lower potential side are supplied when the polarity of the voltage applied to the liquid crystal is negative, the voltage of the input node of the source line driver section can be quickly set by causing the voltage to fall steeply. This makes it possible to further stabilize the voltage of the source line, whereby higher grayscale accuracy can be achieved.

In the source driver, the source line driver section may include an output buffer that drives the source line based on the output from the first DAC or the second DAC; and the source line driver section may drive the source line using the output buffer in a buffer output period within the one the horizontal scan period, and may supply an input voltage of the output buffer to the source line in a DAC output period after the buffer output period.

According to this embodiment, the voltage of the source output can be quickly set in the buffer output period. In this case, the accuracy of the voltage level of the source line is low due to an offset of the output buffer or the like. According to the invention, the input voltage of the output buffer is directly supplied to the source line in the DAC output period. Therefore, the voltage of the source output can be accurately set in the DAC output period.

In the source driver, the buffer output period may overlap a period when the source line driver section drives the source line based on the output from the second DAC.

According to this embodiment, since the source line driver section drives the source line in the buffer output period based on the output voltage from the second DAC, the voltage of the source line can be quickly stabilized at a voltage level with low accuracy.

In the source driver, the DAC output period may start after a start timing of a period when the source line driver section drives the source line based on the output from the first DAC.

According to the invention, the grayscale voltage from the first DAC is supplied to the source line in the DAC output period, whereby the voltage of the source line can be set with high accuracy.

In the source driver, when impedance of a switch signal line among the Q switch signal lines in a period $t_B$ when the source line driver circuit drives the source line based on the output from the second DAC is referred to as $Z_B$, and the impedance of a grayscale signal line among the P grayscale signal lines in a period $t_A$ when the source line driver circuit drives the source line based on the output from the first DAC is referred to as $Z_A$, $t_A/t_B$ may be equal to $Z_A/Z_B$.

According to this embodiment, the voltage of the input node of the source line driver section gradually changes with a time constant determined by the capacitance component and the resistance component of the signal line through which the voltage is transmitted. Since the capacitance component is mainly determined by the input capacitance of the source line driver section, the difference in time constant between the periods $t_A$ and $t_B$ occurs due to the difference between the impedances $Z_A$ and $Z_B$. According to this embodiment, the output from the first DAC can be used for a long period of time without unnecessarily using the output from the second DAC, whereby the grayscale voltage can be supplied to the input node of the source line driver section with high accuracy.

In the source driver,

P may be $2^K$, K being an integer equal to or larger than two, and Q may be $2^{K-L}$, L being a natural number smaller than K.

According to this embodiment, if P and Q are powers of two, the grayscale voltage can be selected using only necessary bits of the grayscale data. Therefore, the configuration of the source driver can be simplified by merely dividing the bits of the grayscale data. Moreover, the layout area of the signal lines and the DACs can be reduced by setting Q to be smaller than P.

In the source driver, the source driver may further comprise a grayscale voltage generation circuit that generates a plurality of grayscale voltages, the plurality of grayscale voltages being obtained by dividing a voltage between given two voltages using resistors, a corresponding grayscale voltage among the plurality of grayscale voltages that are generated by the grayscale voltage generation circuit may be supplied to each of the P grayscale signal lines; and at least one of the Q switch signal lines may be driven by a buffer circuit.

According to this embodiment, the voltage of the grayscale signal line can be set with high accuracy. According to this embodiment, since the voltage of the switch signal line is driven by the buffer circuit, the voltage of the switch signal line can be set quickly. Moreover, since the number of buffer circuits can be reduced as compared with the case of providing a buffer circuit for each grayscale signal line, a significant increase in layout area can be suppressed.

According to another embodiment of the invention, there is provided a source driver that drives a source line of an electro-optical device based on grayscale data, the source driver comprising:

P grayscale signal lines, P being a positive integer equal to or larger than two, a corresponding grayscale signal being supplied to each of the P grayscale signal lines;

Q switch signal lines, Q being a positive integer equal to or smaller than P, a corresponding grayscale signal being supplied to each of the Q switch signal lines;

a first DAC that outputs a grayscale signal among the P grayscale signals supplied to the P grayscale signal lines based on the grayscale data;

a second DAC that outputs a grayscale signal among the Q grayscale signals supplied to the Q switch signal lines based on the grayscale data; and a source line driver section that drives the source line based on an output from the first DAC or the second DAC, the source line driver section generating a second drive signal of the source line based on the output from the second DAC, and then generating a first drive signal of the source line based on the output from the first DAC within one horizontal scan period.

In the source driver, the source driver may further comprise a switch signal select circuit that outputs the Q grayscale signals among at least (Q+1) grayscale signals based on a polarity of a signal applied to an electro-optical substance, a signal of the source line being applied to the electro-optical substance.

Another embodiment of the invention relates to an electro-optical device comprising: a plurality of gate lines; a plurality of source lines; a plurality of pixels, each of the plurality of pixels being specified by a gate line among the plurality of gate lines and a source line among the plurality of source lines; and one of the above source drivers that drives the plurality of source lines.

The electro-optical device according to this embodiment may comprise a gate driver that drives the plurality of gate lines.

According to another embodiment of the invention, there is provided an electro-optical device comprising one of the above source drivers.

According to this embodiment, an electro-optical device can be provided to which a source driver which can achieve high grayscale accuracy even if the number of grayscales increases is applied. According to this embodiment, an electro-optical device can be provided to which a source driver can be provided which can achieve high grayscale accuracy with an increased number of grayscales when polarity inversion drive is performed is applied.

Another embodiment of the invention relates to a projection-type display device comprising: one of the above electro-optical devices; and a light source that emits light to the electro-optical device; and projection means that projects light emitted from the electro-optical device.

According to another embodiment of the invention, there is provided a projection-type display device comprising one of the above source drivers.

According to this embodiment, a projection-type display device can be provided which can achieve high grayscale accuracy even if the number of grayscales increases. According to this embodiment, a projection-type display device can be provided which can achieve high grayscale accuracy with an increased number of grayscales when polarity inversion drive is performed.

Another embodiment of the invention relates to an electronic instrument comprising one of the above electro-optical devices.

Another embodiment of the invention relates to an electronic instrument comprising: one of the above electro-optical devices; and means that supplies grayscale data to the electro-optical device.

According to another embodiment of the invention, there is provided an electronic instrument comprising one of the above source drivers.

According to this embodiment, an electronic instrument can be provided which can achieve high grayscale accuracy even if the number of grayscales increases. According to this embodiment, an electronic instrument can be provided which can achieve high grayscale accuracy with an increased number of grayscales when polarity inversion drive is performed.

Embodiments of the invention are described below in detail with reference to the drawings. Note that the embodiments described below do not in any way limit the scope of the invention laid out in the claims. Note that all elements of the embodiments described below should not necessarily be taken as essential requirements for the invention.

1. Liquid Crystal Device

FIG. 1 shows an outline of the configuration of an active matrix type liquid crystal device according to one embodiment of the invention.

A liquid crystal device 10 includes a liquid crystal display (LCD) panel (display panel in a broad sense; electro-optical device in a broader sense) 20. The LCD panel 20 is formed on a glass substrate, for example. Gate lines (scan lines) GL1 to GLM (M is an integer equal to or larger than two), arranged in a direction Y and extending in a direction X, and source lines (data lines) SL1 to SLN (N is an integer equal to or larger than two), arranged in the direction X and extending in the direction Y, are disposed on the glass substrate. A pixel region (pixel) is formed corresponding to the intersection of the gate line GLm ($1 \leqq m \leqq M$, m is an integer; hereinafter the same) and the source line SLn ($1 \leqq n \leqq N$, n is an integer; hereinafter the same). A thin film transistor (hereinafter abbreviated as "TFT") 22 nm is disposed in the pixel region. An electro-optical device may include a device using a light-emitting element such as an organic electroluminescent (EL) element or an inorganic EL element.

The gate of the TFT 22 mn is connected to the gate line GLm. The source of the TFT 22 mn is connected to the source line SLn. The drain of the TFT 22 mn is connected to a pixel electrode 26 mn. A liquid crystal is sealed between the pixel electrode 26 mn and a common electrode 28 mn opposite to the pixel electrode 26 mn so that a liquid crystal capacitor (element capacitor) (liquid crystal element in a broad sense) 24 mn is formed. The transmissivity of a pixel changes depending on the voltage applied between the pixel electrode 26 mn and the common electrode 28 nm. A common electrode voltage Vcom is supplied to the common electrode 28 mm. The term "element capacitor" may include a liquid crystal capacitor formed in a liquid crystal element or a capacitor formed in an EL element such as an inorganic EL element.

The LCD panel 20 is formed by attaching a first substrate provided with the pixel electrode and the TFT to a second substrate provided with the common electrode, and sealing a liquid crystal as an electro-optical material (electro-optical substance) between the substrates, for example.

The liquid crystal device 10 includes a source driver (display driver in a broad sense; driver circuit in a broader sense) 30. The source driver 30 drives the source lines SL1 to SLN of the LCD panel 20 based on grayscale data.

The liquid crystal device 10 may include a gate driver (scan driver in a broad sense) 32. The gate driver 32 scans the gate lines GL1 to GLM of the LCD panel 20 within one vertical scan period.

The liquid crystal device 10 may include a power supply circuit 100. The power supply circuit 100 generates voltages (signals in a broad sense) necessary for driving the source lines, and supplies the generated voltages to the source driver 30. The power supply circuit 100 generates power supply voltages VDDH and VSSH necessary for the source driver 30 to drive the source lines and voltages necessary for a logic section of the source driver 30, for example.

The power supply circuit 100 also generates voltages necessary for scanning the gate lines, and supplies the generated voltages to the gate driver 32.

The power supply circuit 100 also generates the common electrode voltage Vcom. The power supply circuit 100 outputs the common electrode voltage Vcom, which is periodically set at a high-potential-side voltage VCOMH and a low-potential-side voltage VCOML in synchronization with the timing of a polarity inversion signal POL generated by the source driver 30, to the common electrode of the LCD panel 20.

The liquid crystal device 10 may include a display controller 38. The display controller 38 controls the source driver 30, the gate driver 32, and the power supply circuit 100 according to information set by a host (not shown) such as a central processing unit (hereinafter abbreviated as "CPU"). For example, the display controller 38 sets the operation mode of the source driver 30 and the gate driver 32 and supplies a vertical synchronization signal and a horizontal synchronization signal generated therein to the source driver 30 and the gate driver 32. The display controller 38 or the host may supply grayscale data to the source driver 30.

In FIG. 1, the liquid crystal device 10 is configured to include the power supply circuit 100 and the display controller 38. Note that at least one of the power supply circuit 100 and the display controller 38 may be provided outside the liquid crystal device 10. The liquid crystal device 10 may be configured to include the host.

The source driver 30 may include at least one of the gate driver 32 and the power supply circuit 100.

Figure 2:
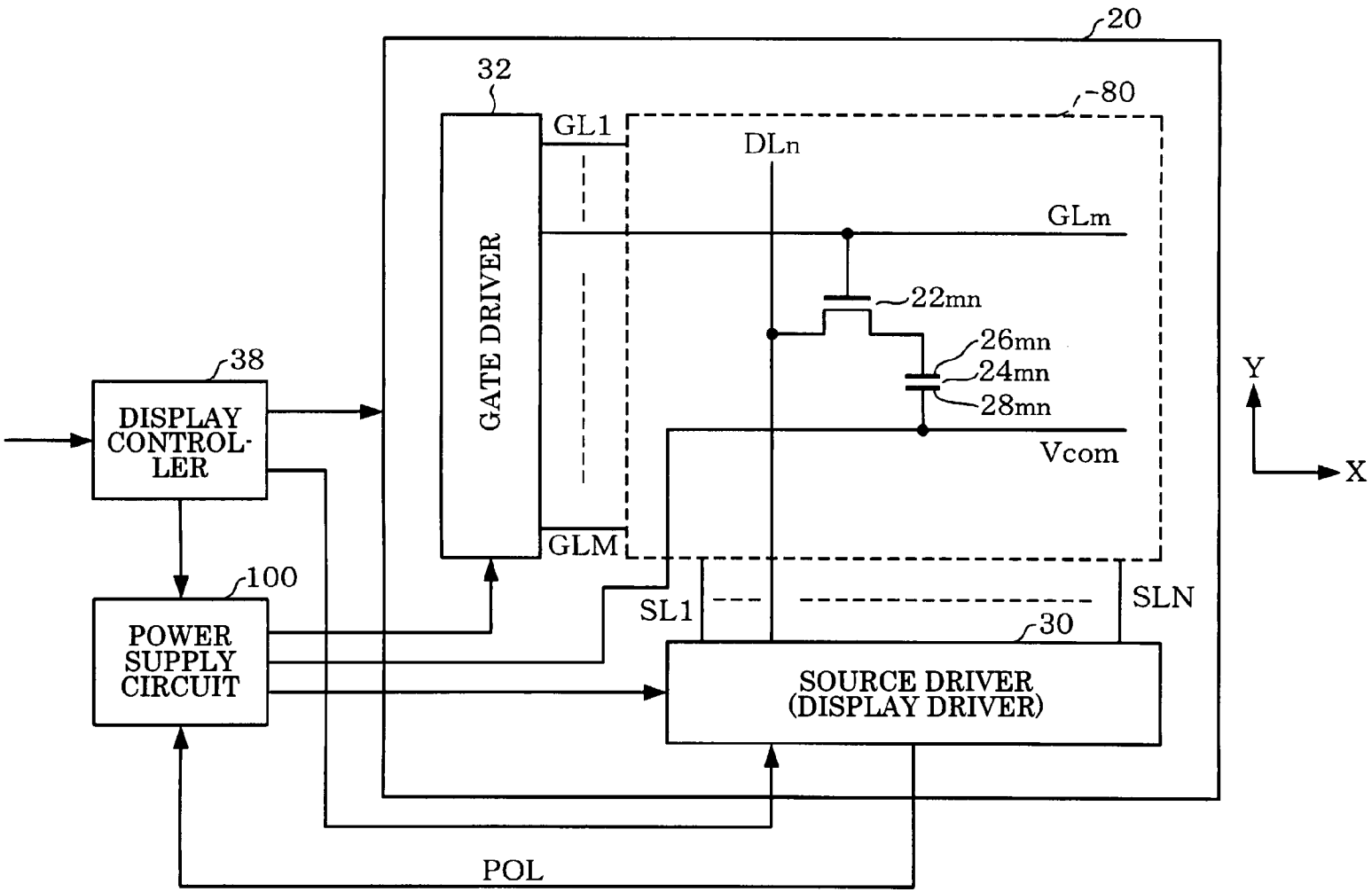
FIG. 2 is a view showing an outline of another configuration of a liquid crystal device according to one embodiment of the invention.

Some or all of the source driver 30, the gate driver 32, the display controller 38, and the power supply circuit 100 may be formed on the LCD panel 20. In FIG. 2, the source driver 30 and gate driver 32 are formed on the LCD panel 20, for example. Specifically, the LCD panel 20 may be configured to include source lines, gate lines, switching elements respectively connected with the gate lines and the source lines, and a source driver which drives the source lines. Pixels are formed in a pixel formation area 80 of the LCD panel 20.

1.1. Gate Driver

Figure 3:
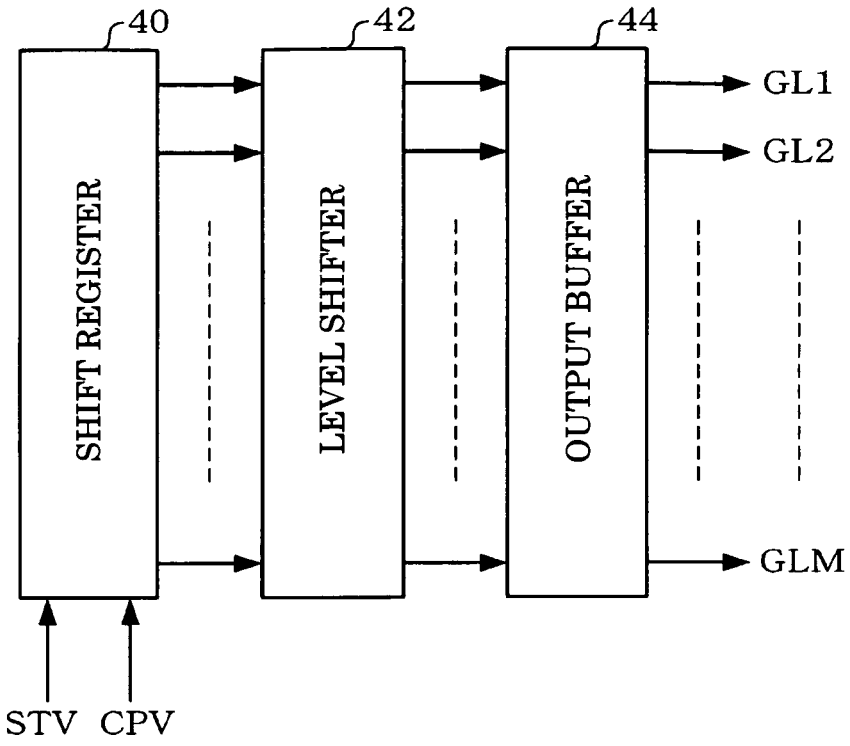
FIG. 3 is a block diagram showing a configuration example of a gate driver shown in FIG. 1 or 2.

FIG. 3 shows a configuration example of the gate driver 32 shown in FIG. 1 or 2.

The gate driver 32 includes a shift register 40, a level shifter 42, and an output buffer 44.

The shift register 40 includes flip-flops provided corresponding to the gate lines and sequentially connected. The shift register 40 holds a start pulse signal STV in the flip-flop in synchronization with a clock signal CPV, and sequentially shifts the start pulse signal STV to the adjacent flip-flops in synchronization with the clock signal CPV. The clock signal CPV is a horizontal synchronization signal, and the start pulse signal STV is a vertical synchronization signal.

The level shifter 42 shifts the level of the voltage output from the shift register 40 to a voltage level corresponding to the liquid crystal element of the LCD panel 20 and the transistor performance of the TFT. A high voltage level of 20 to 50 V is required as the voltage level, for example.

The output buffer 44 buffers the scan voltage shifted by the level shifter 534, and drives the gate line by outputting the scan voltage to the gate line. The high-potential-side voltage of the pulsed scan voltage is a select voltage, and the low-potential-side voltage of the pulsed scan voltage is an unselect voltage.

Figure 4:
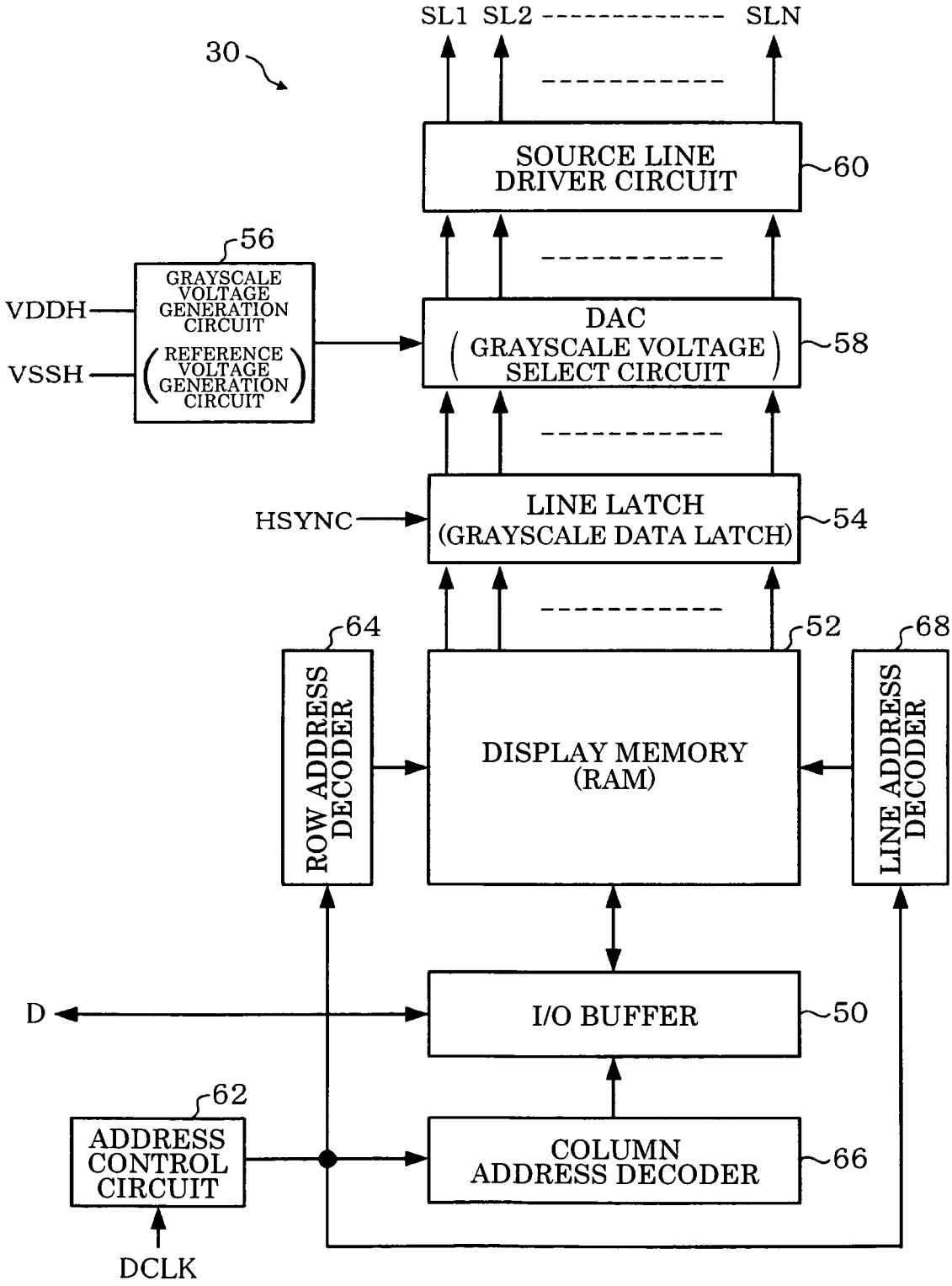
FIG. 4 is a block diagram showing a configuration example of a source driver shown in FIG. 1 or 2.

The gate driver 32 may scan the gate lines by selecting the gate line corresponding to the decoding result of an address decoder instead of scanning the gate lines using the shift register, differing from FIG. 4.

1.2 Source Driver

FIG. 4 is a block diagram showing a configuration example of the source driver 30 shown in FIG. 1 or 2.

The source driver 30 includes an I/O buffer 50, a display memory 52, a line latch 54, a grayscale voltage generation circuit (reference voltage generation circuit in a broad sense; reference signal generation circuit in a broader sense) 56, a digital/analog converter (DAC) (grayscale voltage select circuit in a broad sense; grayscale signal select circuit in a broader sense) 58, and a source line driver circuit (source line driver section) 60.

Grayscale data D is input to the source driver 30 from the display controller 38, for example. The grayscale data D is input in synchronization with a dot clock signal DCLK, and buffered by the I/O buffer 50. The dot clock signal DCLK is supplied from the display controller 38.

The I/O buffer 50 is accessed from the display controller 38 or the host (not shown). The grayscale data buffered by the I/O buffer 50 is written into the display memory 52. The grayscale data read from the display memory 52 is buffered by the I/O buffer 50, and output to the display controller 38 and the like.

The display memory 52 (grayscale data memory) includes memory cells respectively provided corresponding to output lines connected with the source lines. Each memory cell is specified by a row address and a column address. The memory cells of one scan line are specified by a line address.

An address control circuit 62 generates the row address, the column address, and the line address for specifying the memory cell in the display memory 52. The address control circuit 62 generates the row address and the column address when writing the grayscale data into the display memory 52. Specifically, the grayscale data buffered by the I/O buffer 50 is written into the memory cell of the display memory 52 specified by the row address and the column address.

A row address decoder 64 decodes the row address and selects the memory cells of the display memory 52 corresponding to the row address. A column address decoder 66 decodes the column address and selects the memory cells of the display memory 52 corresponding to the column address.

The address control circuit 62 generates the line address when reading the grayscale data from the display memory 52 and outputting the grayscale data to the line latch 54. Specifically, a line address decoder 68 decodes the line address and selects the memory cells of the display memory 52 corresponding to the line address. The grayscale data of one horizontal scan read from the memory cells specified by the line address is output to the line latch 54.

The address control circuit 62 generates the row address and the column address when reading the grayscale data from the display memory 52 and outputting the grayscale data to the I/O buffer 50. Specifically, the grayscale data held by the memory cell of the display memory 52 specified by the row address and the column address is read into the I/O buffer 50.

The grayscale data read into the I/O buffer 50 is acquired by the display controller 38 or the host (not shown).

Therefore, the row address decoder 64, the column address decoder 66, and the address control circuit 62 shown in FIG. 4 function as a write control circuit which controls writing of the grayscale data into the display memory 52. The line address decoder 68, the column address decoder 66, and the address control circuit 62 shown in FIG. 4 function as a read control circuit which controls reading of the grayscale data from the display memory 52.

The line latch 54 latches the grayscale data of one horizontal scan read from the display memory 52 at a change timing of a horizontal synchronization signal HSYNC. The line latch 54 includes registers, each of which holds the grayscale data of one dot. The grayscale data of one dot read from the display memory 52 is written into each register of the line latch 54.

The grayscale voltage generation circuit 56 generates a plurality of grayscale voltages (reference voltages in a broad sense; reference signals in a broader sense) which respectively correspond to pieces of grayscale data. Specifically, the grayscale voltage generation circuit 56 generates the grayscale voltages which respectively correspond to pieces of grayscale data based on a high-potential-side power supply voltage VDDH and a low-potential-side power supply voltage VSSH. More specifically, the grayscale voltage generation circuit 56 generates two grayscale voltage groups. The grayscale voltages of one of the grayscale voltage groups generated by the grayscale voltage generation circuit 56 are respectively supplied to P (P is a positive integer equal to or larger than two) grayscale signal lines provided in the DAC 58. The grayscale voltages of the other grayscale voltage group generated by the grayscale voltage generation circuit 56 are respectively supplied to Q ($Q \leqq P$, Q is a positive integer) charge transfer impact absorption switch signal lines provided in the DAC 58.

The grayscale voltage generation circuit 56 includes two resistor circuits (ladder resistor circuits), the high-potential-side power supply voltage VDDH and the low-potential-side power supply voltage VSSH being supplied to either end of the resistor circuits. The grayscale voltage generation circuit 56 simultaneously outputs P grayscale voltages among the voltages of a plurality of division nodes of one of the resistor circuits, and simultaneously outputs at least (Q+1) grayscale voltages among the voltages of a plurality of division nodes of the other resistor circuit. Alternatively, the grayscale voltage generation circuit 56 simultaneously outputs P grayscale voltages among the voltages of a plurality of division nodes of one of the resistor circuits, and simultaneously outputs Q grayscale voltages among the voltages of a plurality of division nodes of the other resistor circuit.

When the grayscale voltage generation circuit 56 outputs at least (Q+1) grayscale voltages, the grayscale voltage generation circuit 56 outputs Q grayscale voltages optimum for the polarity of the voltage (signal in a broad sense) applied to the liquid crystal. The term "polarity" used herein refers to the polarity of the voltage applied to the liquid crystal (electro-optical substance) sealed between the pixel electrode to which the voltage of the source line is applied and the common electrode provided opposite to the pixel electrode. The term "grayscale voltage optimum for the polarity of the voltage applied to the liquid crystal" used herein refers to a grayscale voltage which can achieve a higher grayscale accuracy.

The DAC 58 generates the grayscale voltages corresponding to the grayscale data output from the line latch 54 in units of output lines (outputs) of the source line driver circuit 60. Specifically, the DAC 58 selects the grayscale voltage corresponding to the grayscale data of one output line of the source line driver circuit 60 output from the line latch 54 from the grayscale voltages generated by the grayscale voltage generation circuit 56, and outputs the selected grayscale voltage.

More specifically, the DAC 58 includes two DACs (i.e., first DAC and second DAC). One of the DACs selects the grayscale voltage corresponding to data of all bits of the grayscale data from the P grayscale voltages supplied to the P grayscale signal lines. The other DAC selects the grayscale voltage corresponding to data of some bits (higher-order bits) of the grayscale data from the Q grayscale voltages supplied to the Q switch signal lines.

It is desirable that P is $2^K$ (K is an integer equal to or larger than two) and Q is $2^{K-L}$ (K>L, L is a natural number). If P and Q are powers of two, the grayscale voltage can be selected using only necessary bits of the grayscale data. Therefore, the configuration of the source driver can be simplified by merely dividing the bits of the grayscale data. Moreover, the layout area of the signal lines and the DACs can be reduced by setting Q to be smaller than P.

The source line driver circuit 60 drives the output lines respectively connected to the source lines of the LCD panel 20. Specifically, the source line driver circuit 60 drives the output lines based on the grayscale voltages output from voltage select circuits of the DAC 58 in output line units. The source line driver circuit 60 includes output circuits provided in output line units. Each output circuit drives the source line based on the grayscale voltage from the corresponding voltage select circuit. Each output circuit is a voltage follower circuit. The voltage follower circuit may be formed using a voltage-follower-connected operational amplifier and the like.

In this embodiment, when changing the grayscale voltage by polarity inversion drive or the like, high grayscale accuracy is implemented by quickly stabilizing the input of each output circuit of the source line driver circuit 60. Therefore, the voltage of the grayscale signal line is supplied to the input of the output circuit of the source line driver circuit 60 after the voltage of the impact-absorption switch signal line is supplied. Specifically, a change in voltage when changing the grayscale voltage is reduced by repeatedly performing capacitance division between the parasitic capacitance of the input of the output circuit and the parasitic capacitance of the signal line. Therefore, even when changing the grayscale voltage by polarity inversion drive or the like, the voltage of the grayscale signal line does not change, whereby a voltage at a stable potential can be supplied to each output circuit of the source line driver circuit 60. Therefore, a source driver which implements high grayscale accuracy can be provided.

A liquid crystal element deteriorates when a direct-current voltage is applied to the liquid crystal element for a long period of time. This makes it necessary to employ a drive method which reverses the polarity of the voltage applied to the liquid crystal element each time a given period has expired. As such a drive method, frame inversion drive, scan (gate) line inversion drive, data (source) line inversion drive, dot inversion drive, and the like are known.

Frame inversion drive reduces power consumption, but results in an insufficient image quality. Data line inversion drive and dot inversion drive provide an excellent image quality, but require a high voltage for driving a display panel.

This embodiment employs scan line inversion drive. Scan line inversion drive reverses the polarity of the voltage applied to the liquid crystal element each time a scan period (scan line) has expired. For example, a positive voltage is applied to the liquid crystal element in the first scan period (scan line), a negative voltage is applied to the liquid crystal element in the second scan period, and a positive voltage is applied to the liquid crystal element in the third scan period. In the subsequent frame, a negative voltage is applied to the liquid crystal element in the first scan period, a positive voltage is applied to the liquid crystal element in the second scan period, and a negative voltage is applied to the liquid crystal element in the third scan period.

Scan line inversion drive causes the polarity of the voltage level of the common electrode voltage Vcom applied to the common electrode CE each time the scan period has expired.

Figure 5:
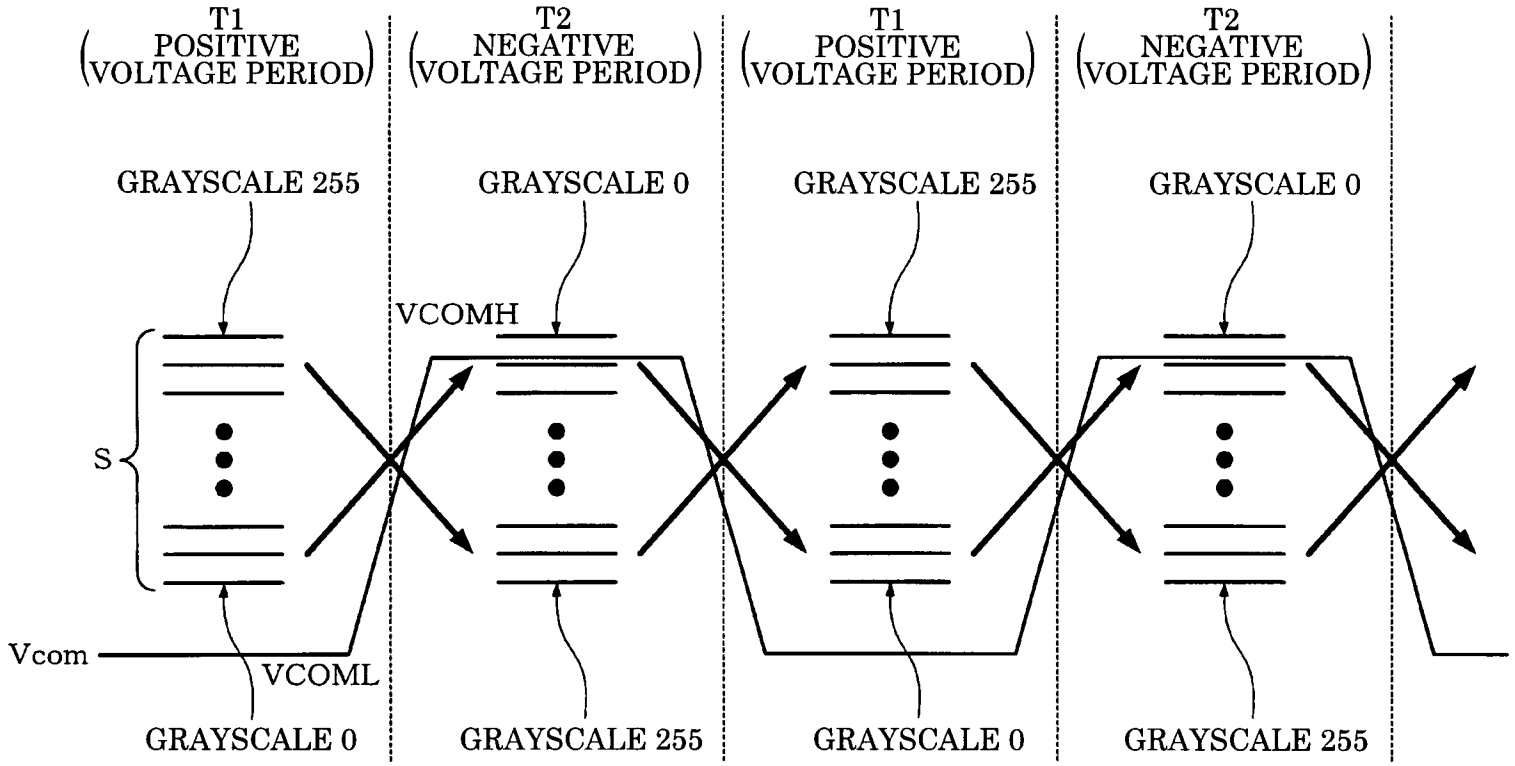
FIG. 5 is a view illustrative of polarity inversion drive according to one embodiment of the invention.

As shown in FIG. 5, the voltage level of the common electrode voltage Vcom is set at a low-potential-side voltage VCOML in a positive period T1 (first period), and is set at a high-potential-side voltage VCOMH in a negative period T2 (second period). The polarity of the grayscale voltage applied to the source line is also reversed at such a timing. Note that the voltage level of the low-potential-side voltage VCOML is the reverse of that of the high-potential-side voltage VCOMH with respect to a given voltage level.

The positive period T1 is a period in which the voltage level of the pixel electrode to which the grayscale voltage is supplied through the source line is higher than the voltage level of the common electrode CE. In the positive period T1, a positive voltage is applied to the liquid crystal element. The negative period T2 is a period in which the voltage level of the pixel electrode to which the grayscale voltage is supplied through the source line is lower than the voltage level of the common electrode CE. In the negative period T2, a negative voltage is applied to the liquid crystal element.

The voltage required to drive the display panel can be reduced by reversing the polarity of the common electrode voltage Vcom. This makes it possible to reduce the withstand voltage of the driver circuit, thereby simplifying the driver circuit manufacturing process and reducing the manufacturing cost.

In this embodiment, the grayscale voltage supplied to each switch signal line may also be changed depending on the polarity of the voltage applied to the liquid crystal. Specifically, before supplying the grayscale voltage of the grayscale signal line having high accuracy to an input node of each output circuit of the source line driver circuit 60, the voltage of the switch signal line is changed depending on the polarity of the voltage applied to the liquid crystal in order to precharge the input node. For example, the voltage of the switch signal line is changed so that the voltage of the switch signal line when a polarity inversion signal (i.e., signal which indicates positive or negative polarity) indicates a positive polarity is higher than the voltage of the switch signal line when the polarity inversion signal indicates a negative polarity. This enables the voltage level of the input node of each output circuit to be quickly stabilized at a level close to the desired voltage level.

The following description is given taking an example in which K is eight and L is three (i.e., the number of grayscale signal lines is 256 ($=2^8$) and the number of switch signal lines is 32 ($=2^5$)). Note that this embodiment is not limited to the number of grayscale signal lines and the number of switch signal lines.

Figure 6:
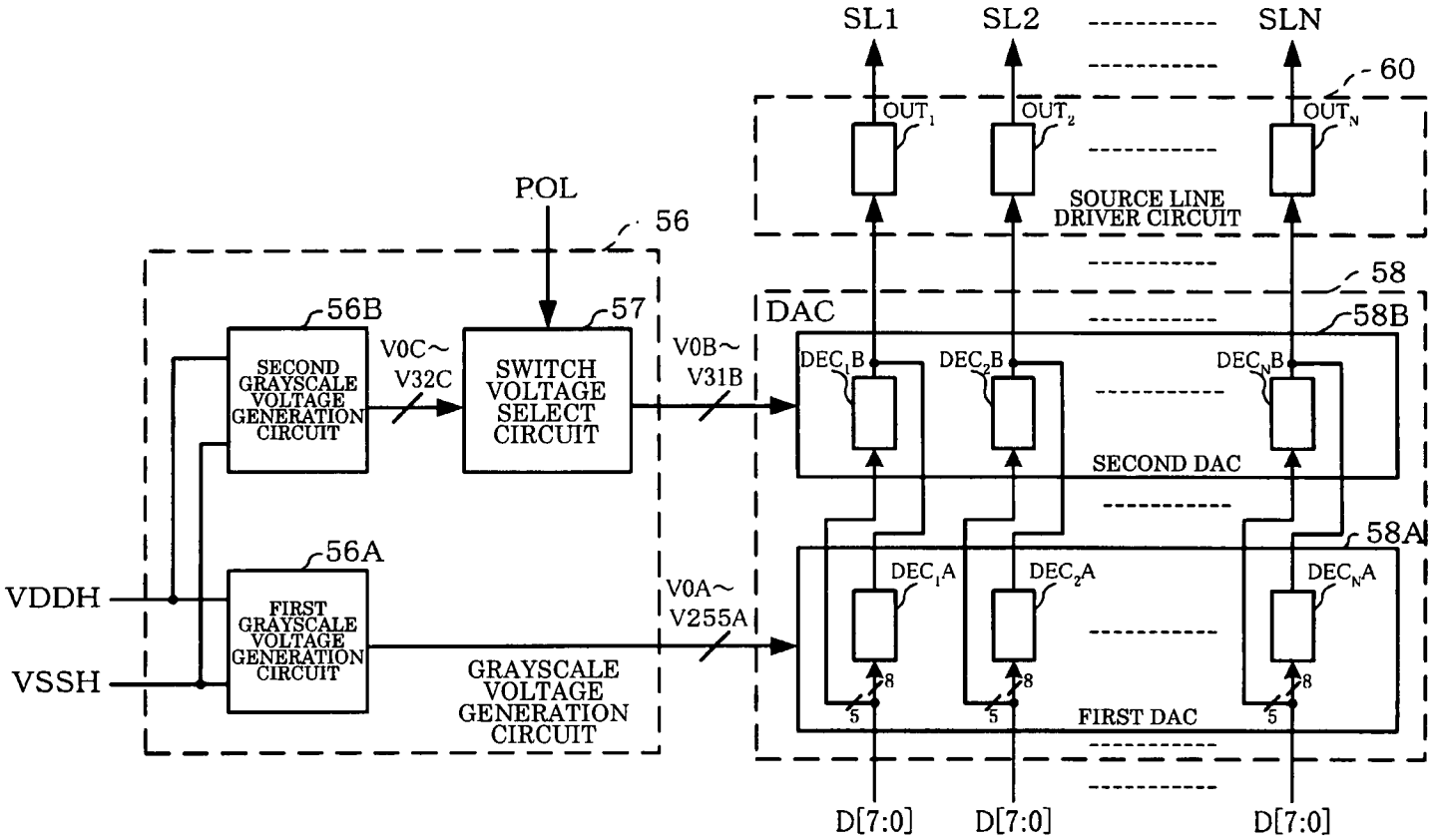
FIG. 6 is a view showing a configuration example of a grayscale voltage generation circuit, a DAC, and a source line driver circuit shown in FIG. 4.

FIG. 6 is a block diagram showing a configuration example of the reference voltage generation circuit 56, the DAC 58, and the source line driver circuit 60 shown in FIG. 4.

In FIG. 6, the same sections as in FIG. 4 are indicated by the same symbols. Description of these sections is appropriately omitted.

The reference voltage generating circuit 56 includes first and second grayscale voltage generation circuits 56A and 56B and a switch voltage select circuit 57. The high-potential-side power supply voltage VDDH and the low-potential-side power supply voltage VSSH are supplied to the first and second grayscale voltage generation circuits 56A and 56B. The first grayscale voltage generation circuit 56A includes a resistor circuit, the high-potential-side power supply voltage VDDH and the low-potential-side power supply voltage VSSH being supplied to either end of the resistor circuit. The first grayscale voltage generation circuit 56A outputs 256 grayscale voltages V0A to V255A by outputting the voltages of a plurality of division nodes provided in the resistor circuit. The second grayscale voltage generation circuit 56B includes a resistor circuit, the high-potential-side power supply voltage VDDH and the low-potential-side power supply voltage VSSH being supplied to either end of the resistor circuit. The second grayscale voltage generation circuit 56B outputs 33 grayscale voltages V0C to V32C by outputting the voltages of a plurality of division nodes provided in the resistor circuit. The following description is given taking an example in which the second grayscale voltage generation circuit 56B outputs 33 grayscale voltages. Note that the second grayscale voltage generation circuit 56B may output 32 or less or 34 or more grayscale voltages.

Figure 7:
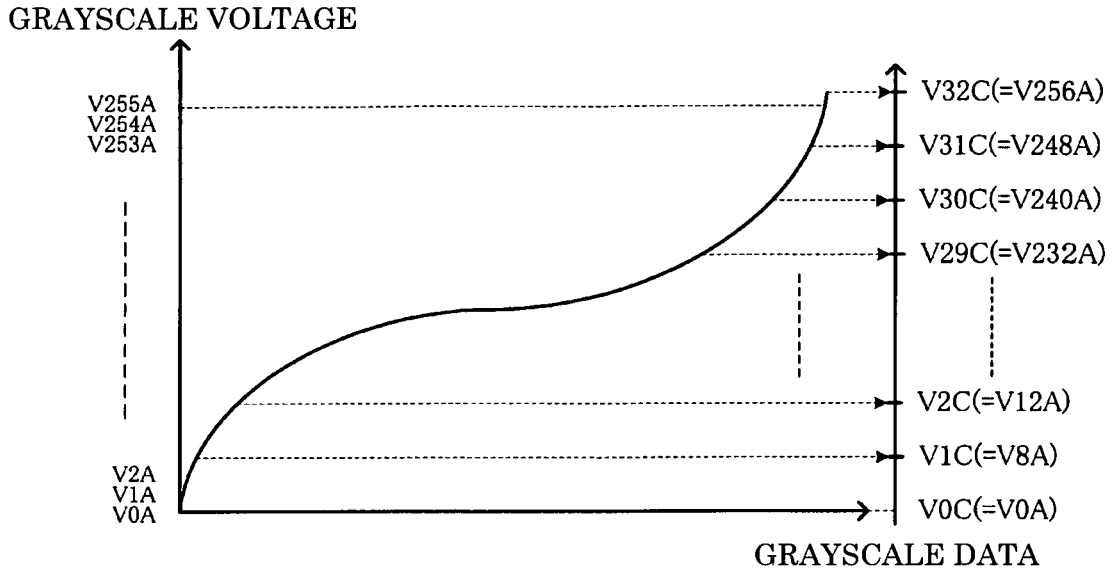
FIG. 7 is a view illustrative of the operation of a grayscale voltage generation circuit shown in FIG. 6.

FIG. 7 is a view illustrative of the operation of the grayscale voltage generation circuit 56 shown in FIG. 6.

The first grayscale voltage generation circuit 56A of the grayscale voltage generation circuits 56 shown in FIG. 6 corrects 256 voltages corresponding to the eight-bit grayscale data corresponding to the grayscale characteristics of the LCD panel 20, and outputs the grayscale voltages V0A to V255A. The second grayscale voltage generation circuit 56B of the grayscale voltage generation circuits 56 shown in FIG. 6 corrects 32 voltages corresponding to the higher-order five bits of the eight-bit grayscale data plus one voltage depending on the grayscale characteristics of the LCD panel 20, and outputs the grayscale voltages V0C to V32C.

In FIG. 7, the grayscale voltage V0A is output as the grayscale voltage V0C, the grayscale voltage V8A is output as the grayscale voltage V1C, the grayscale voltage V16A is output as the grayscale voltage V2C, the grayscale voltage V20A is output as the grayscale voltage V3C, . . . , the grayscale voltage V240A is output as the grayscale voltage V30C, the grayscale voltage V248A is output as the grayscale voltage V31C, and a grayscale voltage V256A is output as the grayscale voltage V32C. The grayscale voltage V256A is a voltage provided on the higher potential side of the grayscale voltage V255A generated by the first grayscale voltage generation circuit 56A.

FIG. 7 shows an example in which each of the grayscale voltages V0C to V31C among the grayscale voltages V0C to V32C generated by the second grayscale voltage generation circuit 56B is one of the grayscale voltages V0A to V255A generated by the first grayscale voltage generation circuit 56A. Note that this embodiment is not limited thereto. For example, the grayscale voltages V0C to V31C generated by the second grayscale voltage generation circuit 56B may differ from the grayscale voltages V0A to V255A generated by the first grayscale voltage generation circuit 56A.

FIG. 6 shows an example in which the first and second grayscale voltages generation circuits 56A and 56B generate a plurality of grayscale voltages using the high-potential-side power supply voltage VDDH and the low-potential-side power supply voltage VSSH. Note that this embodiment is not limited thereto. For example, at least one of the high-potential-side power supply voltage VDDH and the low-potential-side voltage VSSH supplied to the second grayscale voltage generation circuit 56B may be another voltage.

The switch voltage select circuit 57 outputs at least Q grayscale voltages from the (Q+1) grayscale voltages based on the polarity of the voltage applied to the electro-optical substance to which the voltage of the source line is applied. In FIG. 6, the switch voltage select circuit 57 selects 32 grayscale voltages from the grayscale voltages V0C to V32C output from the second grayscale voltage generation circuit 56B, and outputs the selected grayscale voltages as grayscale voltages V0B to V31B. The grayscale voltages V0B to V31B output from the switch voltage select circuit 57 are respectively supplied to the 32 switch signal lines.

Specifically, the switch voltage select circuit 57 changes the output grayscale voltages depending on the polarity of the voltage applied to the liquid crystal. The switch voltage select circuit 57 outputs the grayscale voltages V0B to V31B among the grayscale voltages V0C to V32C output from the second grayscale voltage generation circuit 56B based on a polarity inversion signal POL.

FIGS. 8A and 8B are views illustrative of the operation of the switch voltage select circuit 57 shown in FIG. 6.

FIGS. 8A and 8B show grayscale voltages selected by the switch voltage select circuit 57 from the grayscale voltages V0C to V32C. The following description is given taking an example in which the grayscale voltage V0C among the grayscale voltages V0C to V32C is a voltage at the lowest potential and the grayscale voltage V32C is a voltage at the highest potential for convenience.

In this embodiment, when a positive polarity is specified by the polarity inversion signal POL, the switch voltage select circuit 57 selects the grayscale voltages V1C to V32C from the grayscale voltages V0C to V32C, and outputs the grayscale voltages V1C to V32C as the grayscale voltages V0B to V31B, as shown in FIG. 8A. Specifically, when the polarity of the voltage applied to the liquid crystal is positive, the switch voltage select circuit 57 outputs 32 (=Q) grayscale voltages among the 33 (=(Q+1)) grayscale voltages excluding the grayscale voltage at the lowest potential.

When a negative polarity is specified by the polarity inversion signal POL, the switch voltage select circuit 57 selects the grayscale voltages V0C to V31C from the grayscale voltages V0C to V32C, and outputs the grayscale voltages V0C to V31C as the grayscale voltages V0B to V31B, as shown in FIG. 8B. Specifically, when the polarity of the voltage applied to the liquid crystal is negative, the switch voltage select circuit 57 outputs 32 (=Q) grayscale voltages among the 33 (=(Q+1)) grayscale voltages excluding the grayscale voltage at the highest potential.

In FIG. 6, the DAC 58 includes a first DAC 58A and a second DAC 58B. 256 grayscale signal lines to which the grayscale voltages V0A to V255A are respectively supplied are connected to the first DAC 58A. 32 switch signal lines to which the grayscale voltages V0B to V31B are respectively supplied are connected to the second DAC 58B.

The first DAC 58A includes voltage select circuits $DEC_1A$ to $DEC_NA$ provided in output line units. Each of the voltage select circuits $DEC_1A$ to $DEC_NA$ outputs one grayscale voltage among the grayscale voltages V0A to V255A supplied through the 256 grayscale signal lines as an output voltage DACAOUT based on eight-bit grayscale data D[7:0] stored in the line latch 54.

The second DAC 58B includes voltage select circuits $DEC_1B$ to $DEC_NB$ provided in output line units. Each of the voltage select circuits $DEC_1B$ to $DEC_NB$ outputs one grayscale voltage among the grayscale voltages V0B to V31B A supplied through the 32 switch signal lines as an output voltage DACBOUT based on the high-order five bit data D[7:3] of the grayscale data D[7:0] stored in the line latch 54.

The source line driver circuit 60 includes output circuits $OUT_1$ to $OUT_N$ provided in output line units. Each output circuit generates a source line drive signal (drives the source line) based on the output voltage DACAOUT from the voltage select circuit of the first DAC 58A or the output voltage DACBOUT from the voltage select circuit of the second DAC 58B. Specifically, the output voltage DACAOUT from the voltage select circuit of the first DAC 58A is set as the input voltage of each output circuit, and the output voltage DACBOUT from the voltage select circuit of the second DAC 58B is then set as the input voltage.

This suppresses a change in the input voltage of the output circuit so that a change in the voltage supplied to the source line decreases, whereby high grayscale accuracy can be achieved.

Moreover, since the voltages of the switch signal lines set on the higher potential side are supplied when the polarity of the voltage applied to the liquid crystal is positive, the voltage of the input node of each output circuit can be quickly set by causing the voltage to rise steeply. Likewise, since the voltages of the switch signal lines set on the lower potential side are supplied when the polarity of the voltage applied to the liquid crystal is negative, the voltage of the input node of each output circuit can be quickly set by causing the voltage to fall steeply. This makes it possible to further stabilize the voltage of the source line, whereby higher grayscale accuracy can be achieved.

Figure 9:
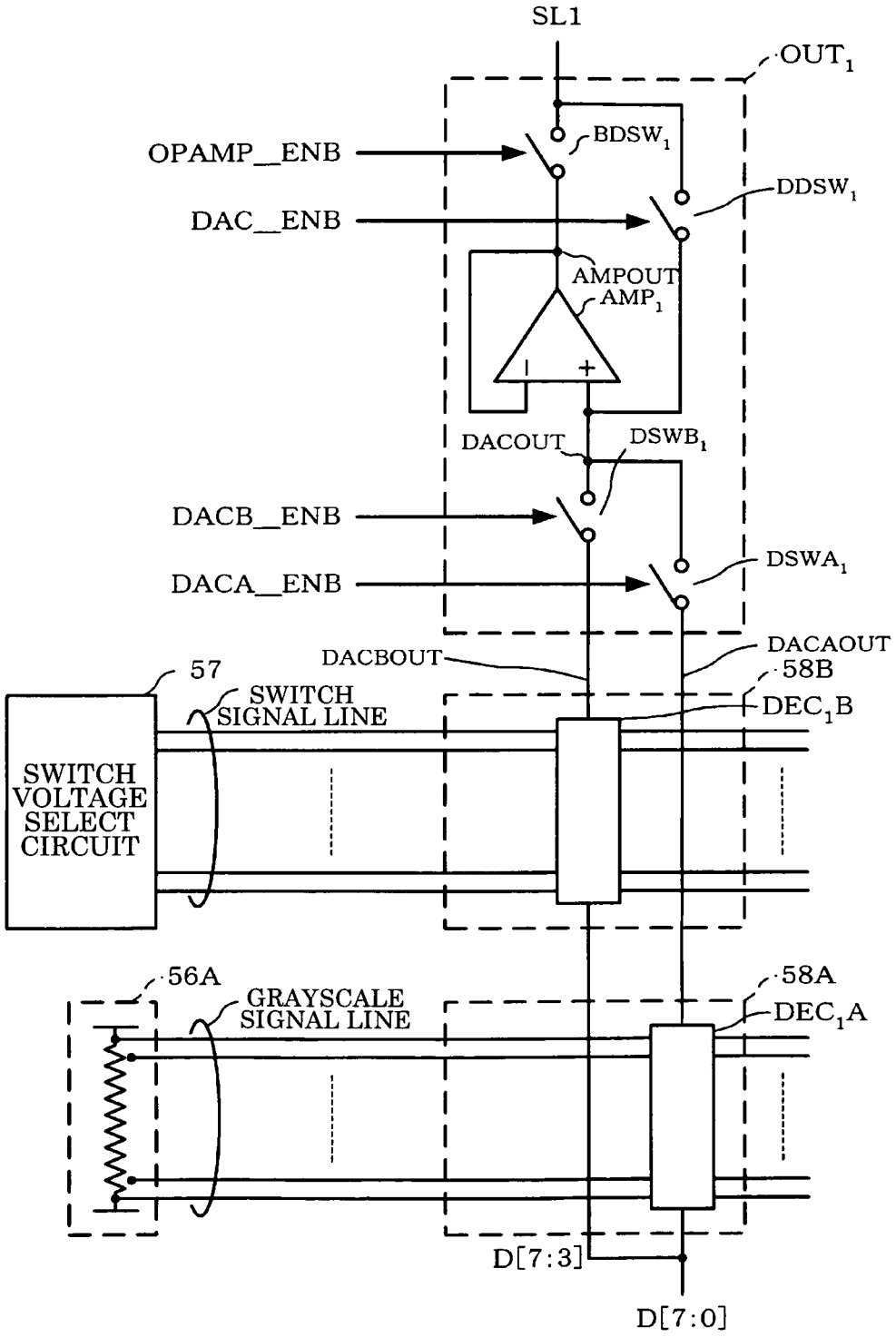
FIG. 9 is a view showing the main portion of the configuration of a source driver shown in FIG. 6 corresponding to one output.

FIG. 9 shows the configuration of the source driver shown in FIG. 6 corresponding to one output.

In FIG. 9, the same sections as in FIG. 6 are indicated by the same symbols. Description of these sections is appropriately omitted. FIG. 9 shows only a portion of the configuration shown in FIG. 6 which drives the source line SL1.

In FIG. 9, the grayscale signal lines are directly connected electrically to the division nodes provided in the resistor circuit of the first grayscale voltage generation circuit 56A. This enables the voltage supplied to the grayscale signal line to be set with high accuracy.

The second grayscale voltage generation circuit 56B (not shown in FIG. 9) includes the resistor circuit, outputs the grayscale voltages to the division nodes provided in the resistor circuit, and generates the 33 grayscale voltages V0C to V32C. The switch voltage select circuit 57 receives the grayscale voltages V0C to V32C, and outputs the grayscale voltages V0B to V31B from the grayscale voltages V0C to V32C. Each switch signal line is electrically connected to a corresponding output node of the switch voltage select circuit 57.

The output circuit $OUT_1$ includes a voltage-follower-connected operational amplifier $AMP_1$ (output buffer in a broad sense), first and second DAC output switches $DSWA_1$ and $DSWB_1$, a buffer drive switch $BDSW_1$, and a DAC drive switch $DDSW_1$.

The output voltage DACAOUT from the voltage select circuit DEC1A of the first DAC 58A is supplied to one end of the first DAC output switch $DSWA_1$, and the other end of the first DAC output switch $DSWA_1$ is electrically connected to a non-inverting input terminal of the operational amplifier $AMP_1$. The first DAC output switch $DSWA_1$ is ON/OFF-controlled using a control signal DACA_ENB generated by a control circuit (not shown) of the source driver 30.

The output voltage DACBOUT from the voltage select circuit DEC1B of the second DAC 58B is supplied to one end of the second DAC output switch $DSWB_1$, and the other end of the second DAC output switch $DSWB_1$ is electrically connected to the non-inverting input terminal of the operational amplifier $AMP_1$. The second DAC output switch $DSWB_1$ is ON/OFF-controlled using a control signal DACB_ENB generated by the control circuit (not shown) of the source driver 30.

An output voltage from the operational amplifier $AMP_1$ is supplied to one end of the buffer drive switch $BDSW_1$, and the output line electrically connected to the source line SL1 is connected to the other end of the buffer drive switch $BDSW_1$. The buffer drive switch $BDSW_1$ is ON/OFF-controlled using a control signal OPAMP_ENB generated by the control circuit (not shown) of the source driver 30.

An input voltage of the operational amplifier $AMP_1$ is supplied to one end of the DAC drive switch $DDSW_1$, and the output line electrically connected to the source line SL1 is connected to the other end of the DAC drive switch $DDSW_1$. The DAC drive switch $DDSW_1$ is ON/OFF-controlled using a control signal DAC_ENB generated by the control circuit (not shown) of the source driver 30.

When the number of switch signal lines is smaller than the number of grayscale signal lines, at least one of the 32 switch signal lines may be driven by a voltage-follower-connected operational amplifier (buffer circuit in a broad sense) in order to quickly stabilize the input voltage of the operational amplifier $AMP_1$. All of the 32 switch signal lines may be driven by a voltage-follower-connected operational amplifier.

In this case, since the voltage of the division node of the resistor circuit is directly supplied to the grayscale signal line, the voltage of the grayscale signal line can be set with high accuracy. Since the voltage of the switch signal line is driven by the operational amplifier, the voltage of the switch signal line can be set quickly. Moreover, since the number of operational amplifiers can be reduced as compared with the case of providing an operational amplifier for each grayscale signal line, a significant increase in layout area can be suppressed.

Although FIG. 9 (FIGS. 12 and 13) shows only the portion which drives the source line SL1, the same description also applies to portions which drive the source lines SL2 to SLN.

FIG. 9 (FIGS. 12 and 13) shows an example in which the first and second DAC output switches $DSWA_1$ and $DSWB_1$ are included in the output circuit $OUT_1$. Note that this embodiment is not limited thereto. The first and second DAC output switches $DSWA_1$ and $DSWB_1$ may be included in the first DAC 58A or the second DAC 58B.

Figure 10:
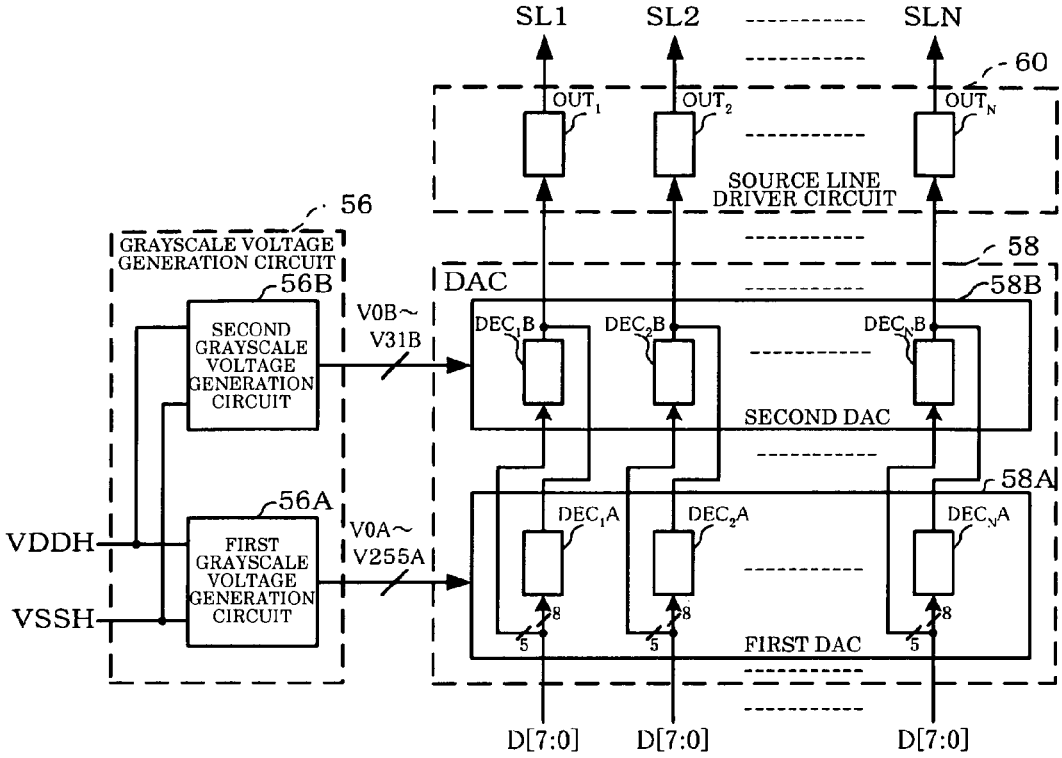
FIG. 10 is a view showing another configuration example of a grayscale voltage generation circuit, a DAC, and a source line driver circuit shown in FIG. 4.

FIG. 10 is a block diagram showing another configuration example of the reference voltage generation circuit 56, the DAC 58, and the source line driver circuit 60 shown in FIG. 4.

In FIG. 10, the same sections as in FIGS. 4 and 6 are indicated by the same symbols. Description of these sections is appropriately omitted.

The reference voltage generating circuit 56 includes the first and second grayscale voltage generation circuits 56A and 56B. The grayscale voltage generation circuit 56 shown in FIG. 10 does not include the switch voltage select circuit 57 shown in FIG. 6.

In FIG. 10, the second grayscale voltage generation circuit 56B includes a resistor circuit, the high-potential-side power supply voltage VDDH and the low-potential-side power supply voltage VSSH being supplied to either end of the resistor circuit. The second grayscale voltage generation circuit 56B outputs 32 grayscale voltages V0B to V31B by outputting the voltages of a plurality of division nodes provided in the resistor circuit.

Figure 11:
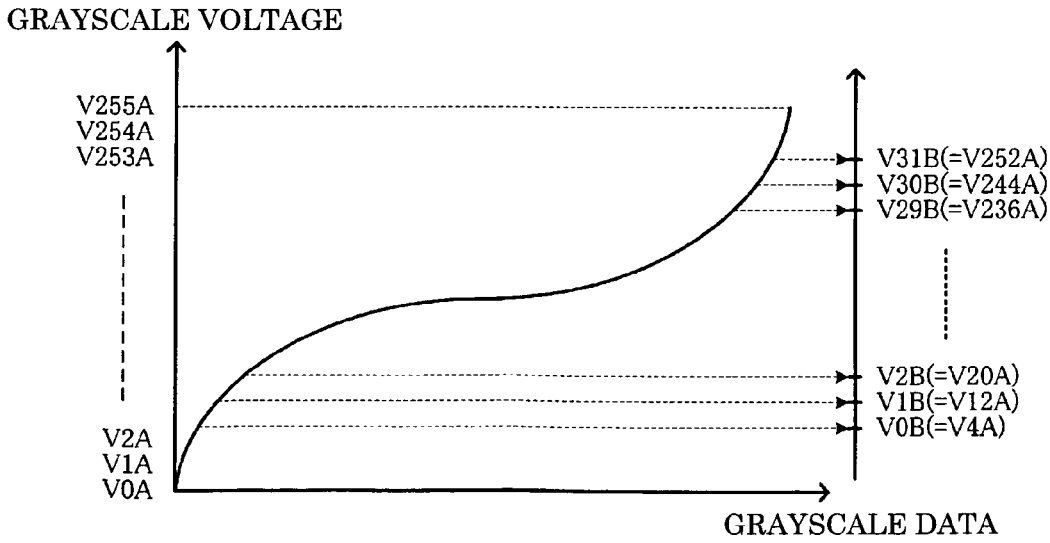
FIG. 11 is a view illustrative of the operation of the grayscale voltage generation circuit shown in FIG. 10.

FIG. 11 is a view illustrative of the operation of the grayscale voltage generation circuit 56 shown in FIG. 10.

In FIG. 11, the same sections as in FIG. 7 are indicated by the same symbols. Description of these sections is appropriately omitted.

The second grayscale voltage generation circuit 56B of the grayscale voltage generation circuits 56 shown in FIG. 10 corrects 32 voltages corresponding to the higher-order five bits of the eight-bit grayscale data depending on the grayscale characteristics of the LCD panel 20, and outputs the corrected voltages as the grayscale voltages V0B to V31B. In FIG. 11, the grayscale voltage V4A is output as the grayscale voltage V0B, the grayscale voltage V12A is output as the grayscale voltage V1B, the grayscale voltage V20A is output as the grayscale voltage V2B, . . . , the grayscale voltage V244A is output as the grayscale voltage V30B, and the grayscale voltage V252A is output as the grayscale voltage V31B.

FIG. 11 shows an example in which each of the grayscale voltages V0B to V31B generated by the second grayscale voltage generation circuit 56B is one of the grayscale voltage V255A generated by the first grayscale voltage generation circuit 56A. Note that this embodiment is not limited thereto. For example, the grayscale voltages V0B to V31B generated by the second grayscale voltage generation circuit 56B may differ from the grayscale voltages V0A to V255A generated by the first grayscale voltage generation circuit 56A.

Figure 12:
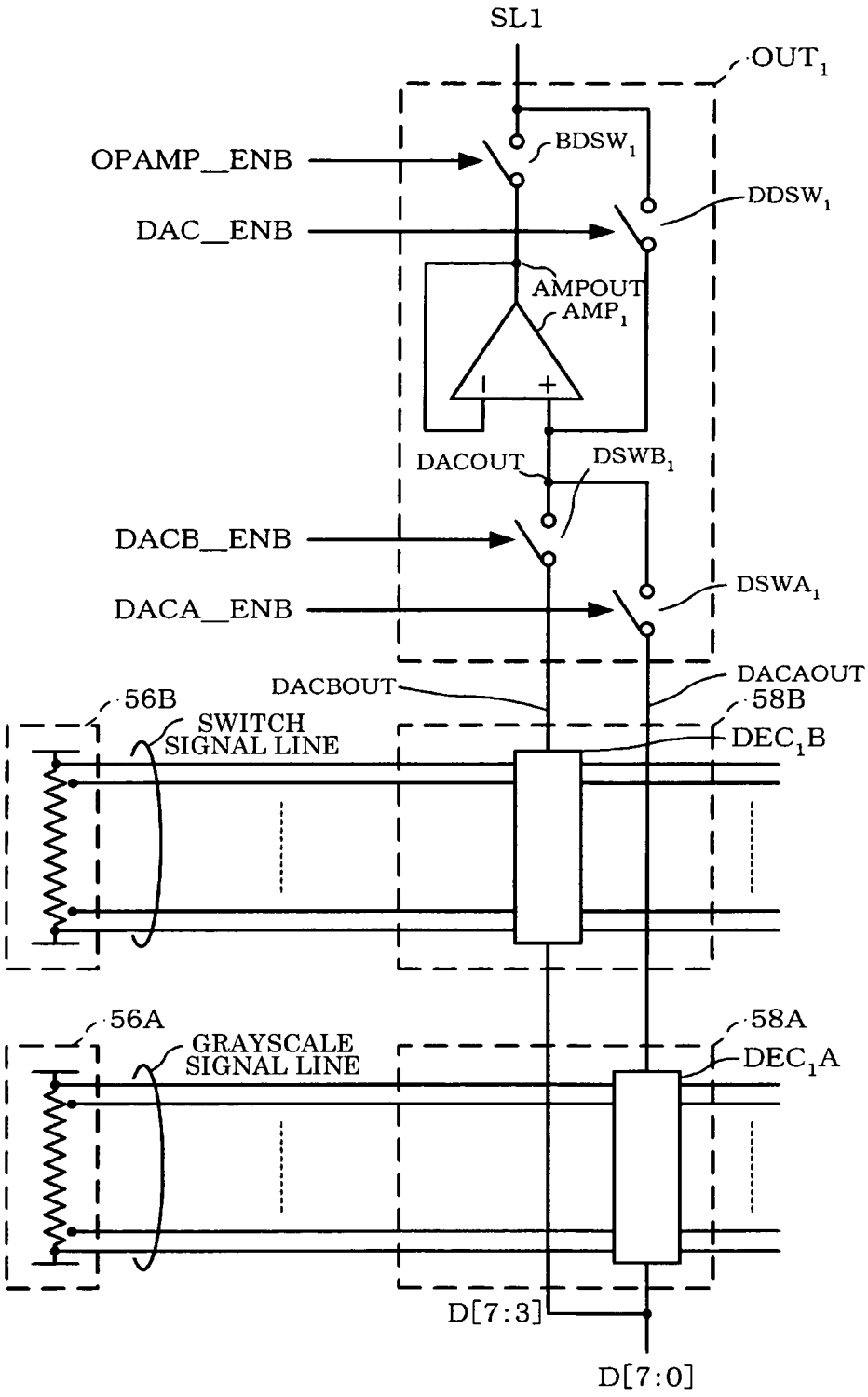
FIG. 12 is a view showing the main portion of the configuration of a source driver shown in FIG. 1 corresponding to one output.

FIG. 12 shows the configuration of the source driver shown in FIG. 10 corresponding to one output.

In FIG. 12, the same sections as in FIGS. 10 and 9 are indicated by the same symbols. Description of these sections is appropriately omitted. FIG. 12 shows only a portion of the configuration shown in FIG. 10 which drives the source line SL1.

In FIG. 12, the grayscale signal lines are directly connected electrically to the division nodes provided in the resistor circuit of the first grayscale voltage generation circuit 56A. In FIG. 12, the switch signal lines are directly connected electrically to the division nodes provided in the resistor circuit of the second grayscale voltage generation circuit 56B. This enables the voltage supplied to the grayscale signal line and the voltage supplied to the switch signal line to be set with high accuracy.

Figure 13:
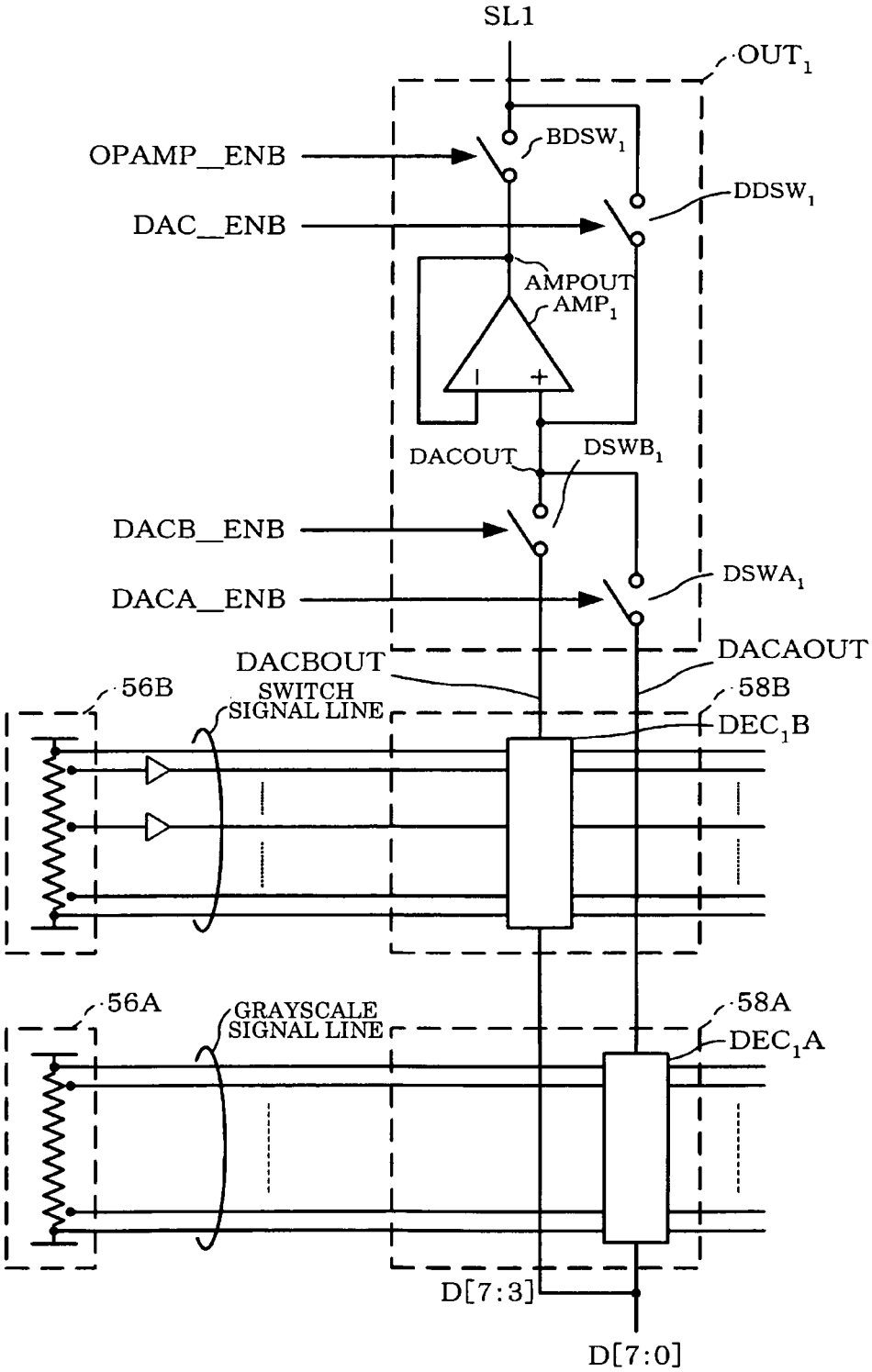
FIG. 13 is a view showing another example of the major portion of the configuration of a source driver shown in FIG. 11 corresponding to one output.

When the number of switch signal lines is smaller than the number of grayscale signal lines, at least one of the 32 switch signal lines may be driven by a voltage-follower-connected operational amplifier (buffer circuit in a broad sense) in order to quickly stabilize the input voltage of the operational amplifier $AMP_1$, as shown in FIG. 13.

Figure 14:
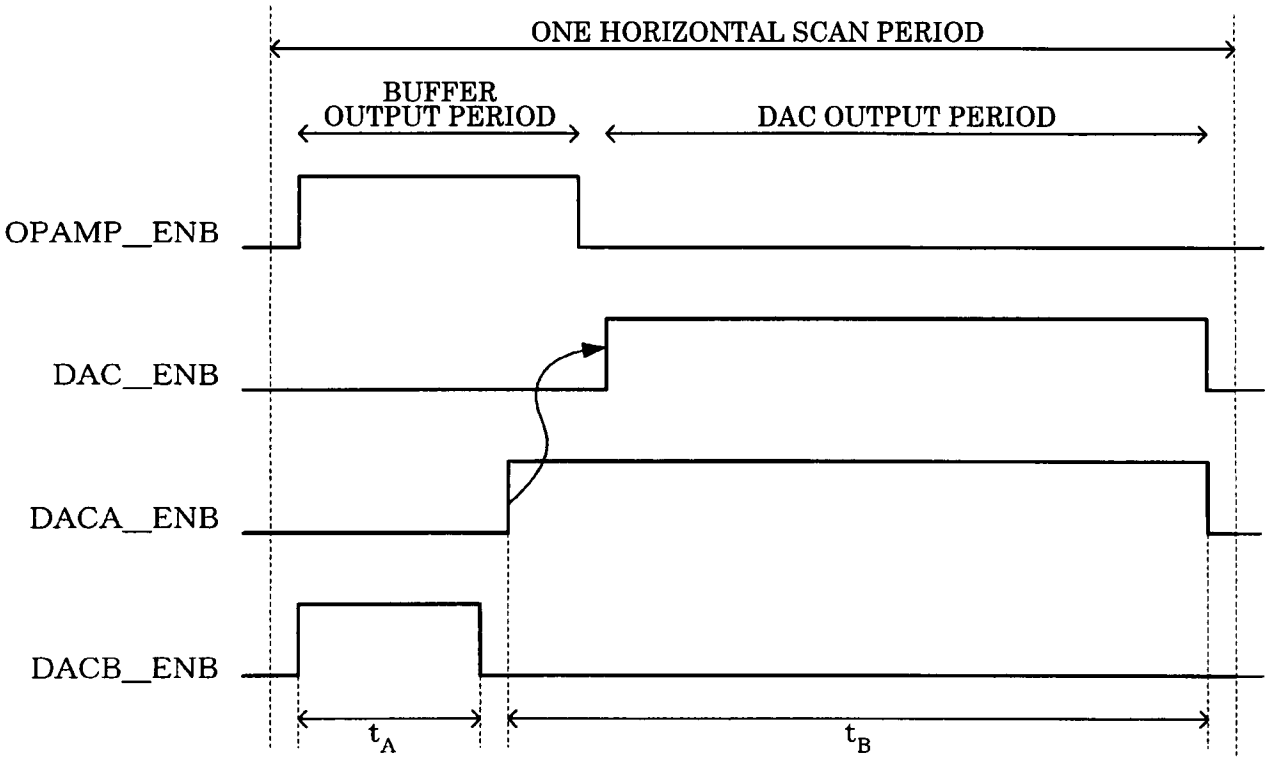
FIG. 14 is a view showing a timing example of control signals shown in FIG. 9 or 12.

FIG. 14 shows an example of the timings of the control signals shown in FIG. 9 or 12.

In this embodiment, a buffer output period is provided in the first period of a drive period within one horizontal scan period, and a DAC output period is provided in the second period of the drive period. The control circuit (not shown) controls the control signals so that the control signal OPAMP_ENB is set at the H level in the buffer output period and the control signal DAC_ENB is set at the H level in the DAC output period. The control signals OPAMP_ENB and DAC_ENB are not set at the H level at the same time.

Therefore, the operational amplifier $AMP_1$ drives the source line SL1 in the buffer output period, and the input voltage of the operational amplifier $AMP_1$ is supplied to the source line SL1 in the DAC output period. Specifically, the source line is driven by the operational amplifier $AMP_1$ in the buffer output period within one horizontal scan period, and the input voltage of the operational amplifier $AMP_1$ is supplied to the source line SL1 in the DAC output period after the buffer output period.

As a result, the voltage of the source line SL1 is quickly set in the buffer output period. In this case, the accuracy of the voltage level of the source line SL1 is lower than the accuracy of the voltage level of the grayscale voltage generated by the first grayscale voltage generation circuit 56A due to an offset of the operational amplifier $AMP_1$ or the like. Therefore, the source line SL1 is set at the grayscale voltage generated by the DAC 58 in the DAC output period. This enables the voltage of the source line SL1 to be accurately set in the DAC output period.

In this embodiment, the grayscale voltage from the second DAC 58B is supplied as the input voltage of the source line driver circuit 60 (operational amplifier $AMP_1$), and the grayscale voltage from the first DAC 58A is then supplied as the input voltage of the source line driver circuit 60. Specifically, the source line driver circuit 60 drives the source line based on the output from the second DAC 58B and then drives the source line based on the output from the first DAC 58A within one horizontal scan period.

Therefore, the control circuit (not shown) sets the control signal DACB_ENB at the H level and then sets the control signal DACA_ENB at the H level in the drive period within one horizontal scan period. The control signals DACA_ENB and DACB_ENB are not set at the H level at the same time.

Specifically, the control circuit generates the control signals OPAMP_ENB and DACB_ENB so that the buffer output period overlaps a period in which the source line driver circuit 60 drives the source line SL1 based on the output from the second DAC 58B. Therefore, since the operational amplifier $AMP_1$ drives the source line in the buffer output period based on the output voltage from the second DAC 58B, the voltage of the source line can be quickly stabilized at a voltage level with low accuracy.

The control circuit generates the control signals DAC_ENB and DACA_ENB so that the DAC output period starts after the start timing of a period in which the source line driver circuit 60 drives the source line SL1 based on the output from the first DAC 58A. Therefore, the grayscale voltage from the first DAC 58A is supplied to the source line SL1 in the DAC output period, whereby the voltage of the source line can be set with high accuracy.

According to this embodiment, since the grayscale voltage from the second DAC 58B is supplied as the input voltage of the source line driver circuit 60 and the grayscale voltage from the first DAC 58A is then supplied as the input voltage of the source line driver circuit 60, a change in the voltage of the source line driven by the source line driver circuit 60 can be suppressed.

The configuration according to this embodiment is not limited to the configuration shown in FIG. 9. A configuration in which the DAC drive switch $DDSW_1$ is omitted may also be employed.

Figure 15:
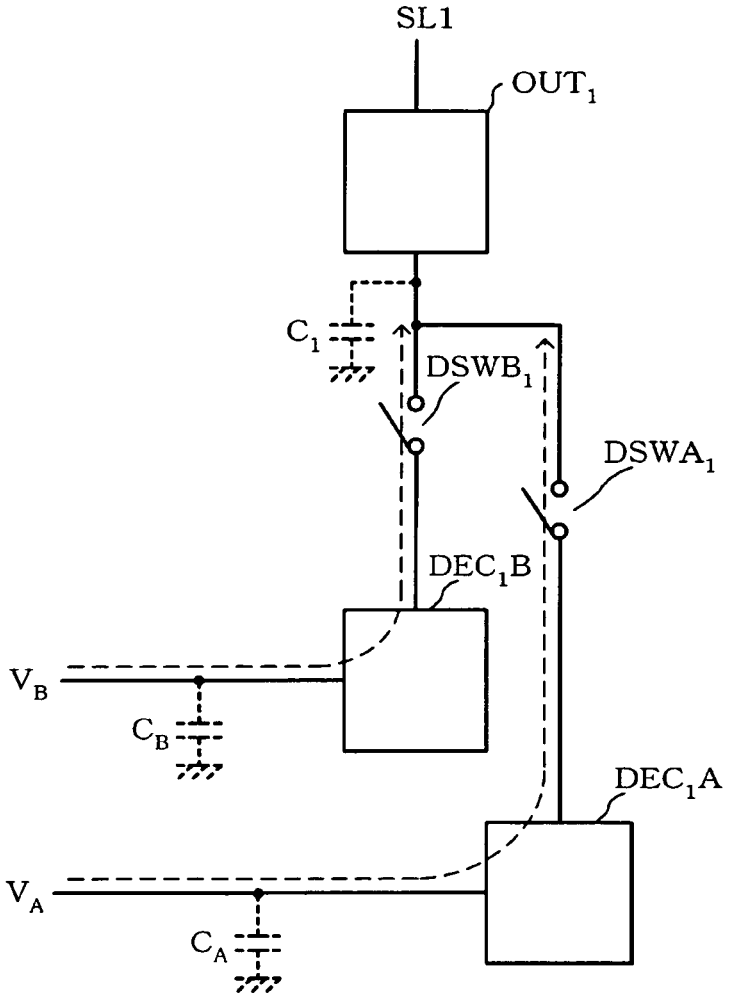
FIG. 15 is a view illustrative of one embodiment of the invention.

FIG. 15 is a view illustrative of this embodiment.

FIG. 15 schematically shows the main portion of FIG. 9 or 12. In FIG. 15, the same sections as in FIG. 9 or 12 are indicated by the same symbols. Description of these sections is appropriately omitted. In FIG. 15, the first and second DAC output switches $DSWA_1$ and $DSWB_1$ are provided outside the output circuit $OUT_1$ for convenience of description.

In FIG. 15, the voltage of one grayscale signal line selected by the first DAC 58A based on the grayscale data is referred to as a grayscale voltage $V_A$, and the voltage of one switch signal line selected by the second DAC 58B based on the higher-order-bit data of the grayscale data is referred to as a grayscale voltage $V_B$. A parasitic capacitor of the grayscale signal line to which the grayscale voltage $V_A$ is supplied is referred to as $C_A$, a parasitic capacitor of the switch signal line to which grayscale voltage $V_B$ is supplied is referred to as $C_B$, and a parasitic capacitor of the input node of the output circuit $OUT_1$ (operational amplifier $AMP_1$) of the source line driver circuit 60 is referred to as $C_1$.

The drive voltage of the source line SL1 in a horizontal scan period immediately before the present horizontal scan period is a voltage V1. As a comparative example according to this embodiment, when driving the source line using the voltage selected by the first DAC 58A in the present horizontal scan period, the voltage of the input node of the output circuit OUT1 changes from the voltage $V_1$ to the voltage $V_A$. In this comparative example, a charge corresponding to ($V_1$-$V_A$) is charged or discharged. In this case, when the change in voltage has a high amplitude due to polarity inversion drive or the like, a large amount of charging or discharging occurs between the input node and the grayscale signal line, whereby the voltage levels of the input node and the grayscale signal line are not immediately stabilized (converged).

In this embodiment, the change in voltage level is absorbed by the switch signal line connected to the second DAC 58B. Since charging or discharging then occurs between the grayscale signal line connected to the first DAC 58A and the input node of the output circuit $OUT_1$, the amount of charging or discharging can be reduced to a large extent as compared with the comparative example, whereby the voltage levels of the input node and the grayscale signal line can be immediately stabilized (converged).

Specifically, when the grayscale voltage from the second DAC 58B is supplied to the input node of the output circuit $OUT_1$, charging or discharging occurs between the parasitic capacitors $C_1$ and $C_B$.

When the grayscale voltage from the first DAC 58A is supplied to the input node of the output circuit $OUT_1$, charging or discharging occurs between the parasitic capacitors $C_1$ and $C_A$. In this case, a charge corresponding to the voltage $V_B$ close to the voltage $V_A$ has been stored in the parasitic capacitor $C_1$. Therefore, the amount of charging or discharging when the grayscale voltage from the first DAC 58A is supplied to the input node of the output circuit $OUT_1$ is reduced.

In this embodiment, as shown in FIG. 14, when the impedance of one switch signal line (one switch signal line selected by the second DAC 58B) in a period $t_B$ in which the source line driver circuit 60 drives the source line based on the output from the second DAC 58B is referred to as $Z_B$, and the impedance of one grayscale signal line (one grayscale signal line selected by the first DAC 58A) in a period $t_A$ in which the source line driver circuit 60 drives the source line based on the output from the first DAC 58A is referred to as $Z_A$, it is desirable that the control circuit (not shown) generate the control signals DACA_ENB and DACB_ENB so that $t_A/t_B$ equals $Z_A/Z_B$.

The impedance of the switch signal line corresponds to the sum of the resistance component of the switch signal line and the on-resistance component of the switching element of the second DAC 58B. The impedance of the grayscale signal line corresponds to the sum of the resistance component of the grayscale signal line and the on-resistance component of the switching element of the first DAC 58A.

The voltage of the input node of the output circuit $OUT_1$ gradually changes with a time constant determined by the capacitance component and the resistance component from the grayscale voltage generation circuit. Since the capacitance component is mainly determined by the input capacitance of the output circuit $OUT_1$, the difference in time constant between the periods $t_A$ and $t_B$ occurs due to the difference between the impedances $Z_A$ and $Z_B$. Therefore, if the control signals DACA_ENB and DACB_ENB are generated as stated above, the control signal DACA_ENB can be set at the H level for a period of time without unnecessarily setting the control signal DACB_ENB at the H level. As a result, the grayscale voltage can be supplied to the input node of the output circuit $OUT_1$ with high accuracy.

Configuration examples of the switch voltage select circuit 57 shown in FIG. 9, the first DAC 58A, the second DAC 58B, and the operational amplifier $AMP_1$ shown in FIGS. 9, 12, and 13 are described below.

1.2.1 Switch Voltage Select Circuit

Figure 16:
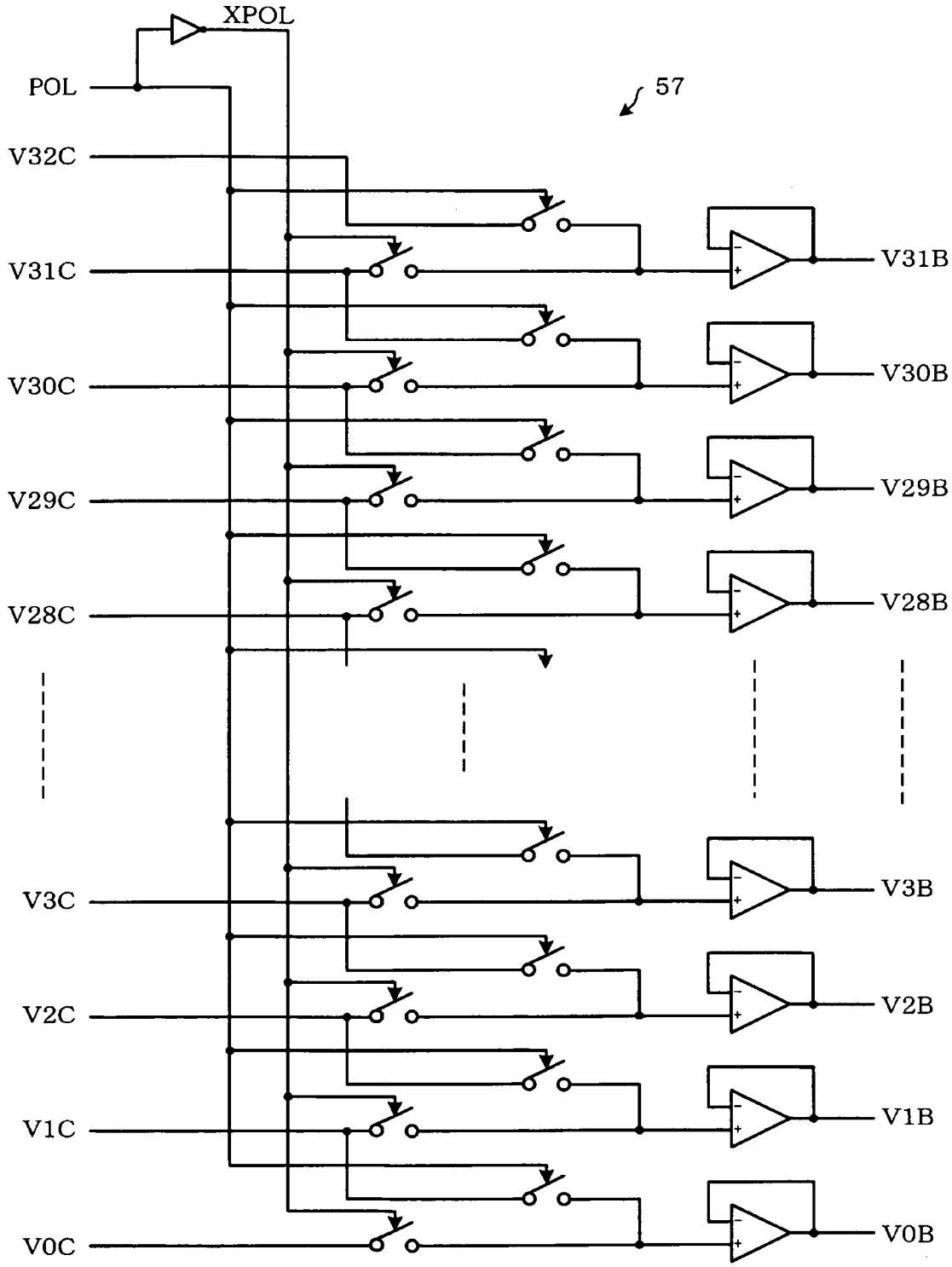
FIG. 16 is a circuit diagram showing a configuration example of a switch voltage select circuit shown in FIG. 9.

FIG. 16 is a circuit diagram showing a configuration example of the switch voltage select circuit 57 shown in FIG. 9.

The grayscale voltages V0C to V32C generated by the second grayscale voltage generation circuit 56B and the polarity inversion signal POL are input to the switch voltage select circuit 57 shown in FIG. 16. The switch voltage select circuit 57 includes 32 voltage-follower-connected operational amplifiers, the output of each operational amplifier (buffer circuit) being connected to the corresponding switch signal line. The switch voltage select circuit 57 outputs the grayscale voltages V0B to V31B to the 32 switch signal lines using these operational amplifiers.

Therefore, one of two adjacent grayscale voltages is input to the input of each operational amplifier based on the polarity inversion signal POL. In FIG. 16, when the polarity inversion signal POL is set at the H level, the grayscale voltage V32C is supplied to the input of the operational amplifier which outputs the grayscale voltage V31B. When the polarity inversion signal POL is set at the L level, the grayscale voltage V31C is supplied to the input of the operational amplifier which outputs the grayscale voltage V31B, for example. Likewise, when the polarity inversion signal POL is set at the H level, the grayscale voltage V31C is supplied to the input of the operational amplifier which outputs the grayscale voltage V30B. When the polarity inversion signal POL is set at the L level, the grayscale voltage V30C is supplied to the input of the operational amplifier which outputs the grayscale voltage V30B. When the polarity inversion signal POL is set at the H level, the grayscale voltage V1C is supplied to the input of the operational amplifier which outputs the grayscale voltage V0B. When the polarity inversion signal POL is set at the L level, the grayscale voltage V0C is supplied to the input of the operational amplifier which outputs the grayscale voltage V0B.

According to the above configuration, the switch voltage select circuit 57 can output 32 grayscale voltages among the 33 grayscale voltages excluding the grayscale voltage at the lowest potential when the polarity of the voltage applied to the liquid crystal is positive. The switch voltage select circuit 57 can output 32 grayscale voltages among the 33 grayscale voltages excluding the grayscale voltage at the highest potential when the polarity of the voltage applied to the liquid crystal is negative.

1.2.2 First DAC

Figure 17:
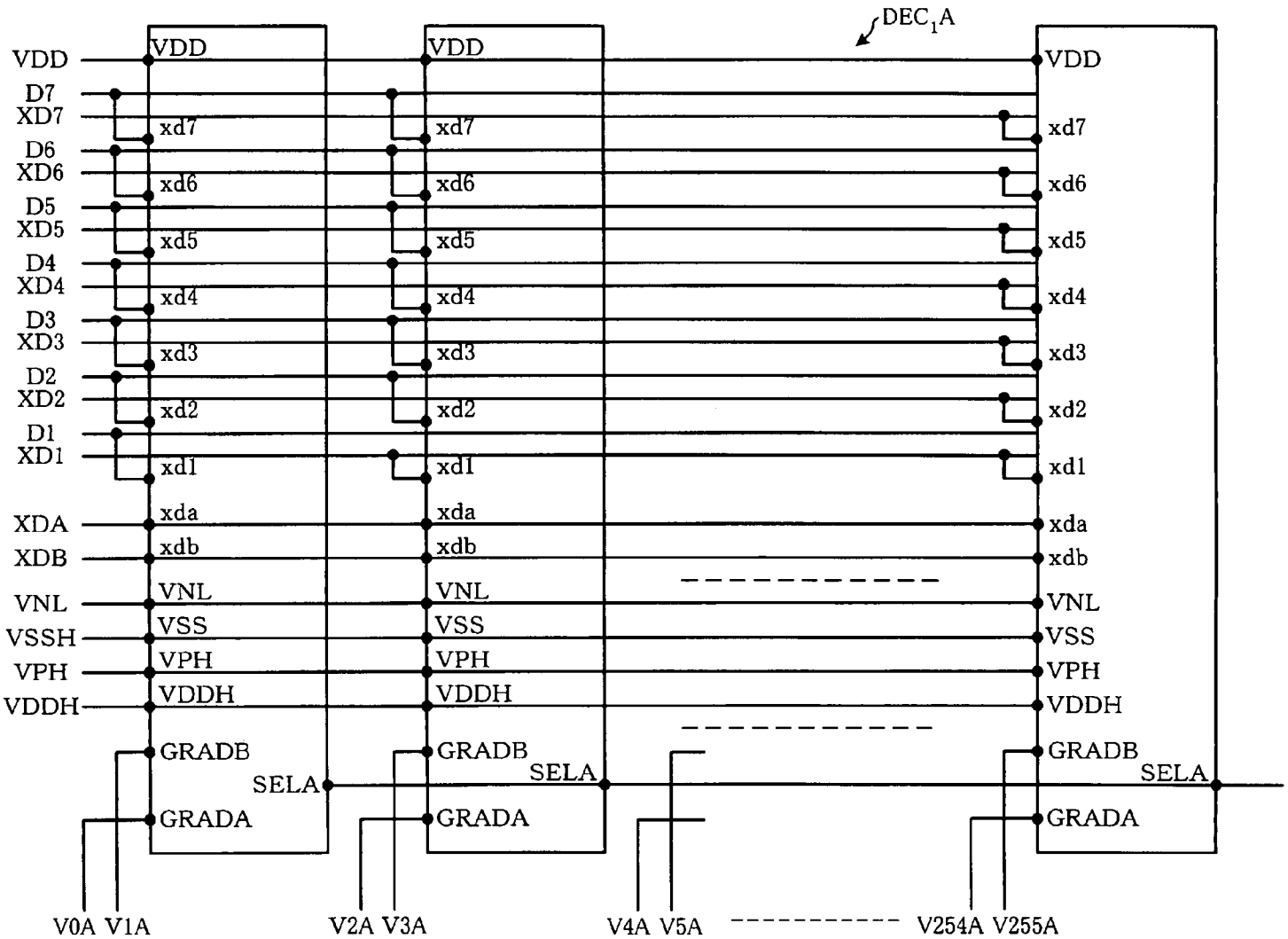
FIG. 17 is a block diagram showing a configuration example of a voltage select circuit of a first DAC shown in FIG. 9, 12, or 13.

FIG. 17 is a block diagram showing a configuration example of the voltage select circuit $DEC_1A$ of the first DAC 58A shown in FIG. 9, 12, or 13.

FIG. 17 shows a configuration example of the voltage select circuit $DEC_1A$ among the voltage select circuits $DEC_1A$ to $DEC_NA$. Note that the voltage select circuits $DEC_2A$ to $DEC_NA$ have the same configuration as that of the voltage select circuit $DEC_1A$.

The voltage select circuit $DEC_1A$ has a plurality of voltage select blocks (128 voltage select blocks). Each voltage select block shown in FIG. 17 has an identical configuration. The voltages VDD, VNL, VSSH, VPH, and VDDH, the data D7 to D1, and inversion data XD7 to XD1, XDA, and XDB are input to the voltage select blocks. The inversion data XD7 to XD1 is data obtained by reversing the seven-bit data D7 to D1 of the grayscale data excluding the least significant bit. The inversion data XDA is set at the H level when the least significant bit data D0 of the grayscale data is "1". The inversion data XDB is set at the H level when the least significant bit data D0 of the grayscale data is "0".

For example, the data D7 to D1 is input to the voltage select block which selects one voltage from the grayscale voltages V0A and V1A, the data D7 to D2 and the inversion data D1 are input to the voltage select block which selects one voltage from the grayscale voltages V2A and V3A, and the inversion data XD7 to XD1 is input to the voltage select block which selects one voltage from the grayscale voltages V254A and V255A.

Two adjacent grayscale voltages among the grayscale voltages V0A to V255A are sequentially input to each voltage select block. Each voltage select block outputs a voltage SELA from the two grayscale voltages.

Figure 18:
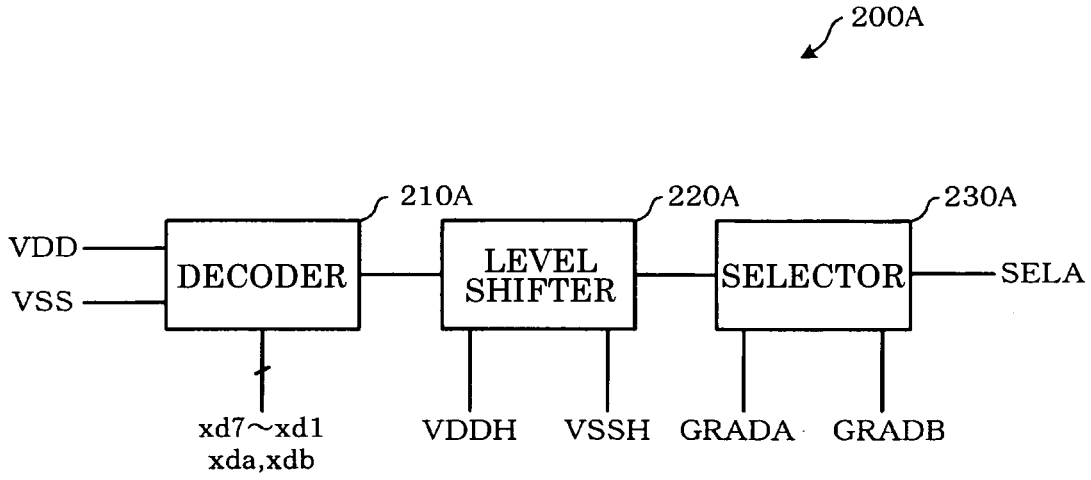
FIG. 18 is a view showing an outline of the configuration of the voltage select block shown in FIG. 17.

FIG. 18 shows an outline of the configuration of the voltage select block shown in FIG. 17.

A voltage select block 200A includes a decoder 210A, a level shifter 220A, and a selector 230A. The decoder 210A generates a switch control signal based on inversion data xd7 to xd1, xda, and xdb. The level shifter 220A converts the switch control signal into a voltage level between the voltages VDDH and VSSH. The selector 230A outputs the voltage SELA from voltages GRADA and GRADB based on the switch control signal converted by the level shifter 220A.

Figure 19:
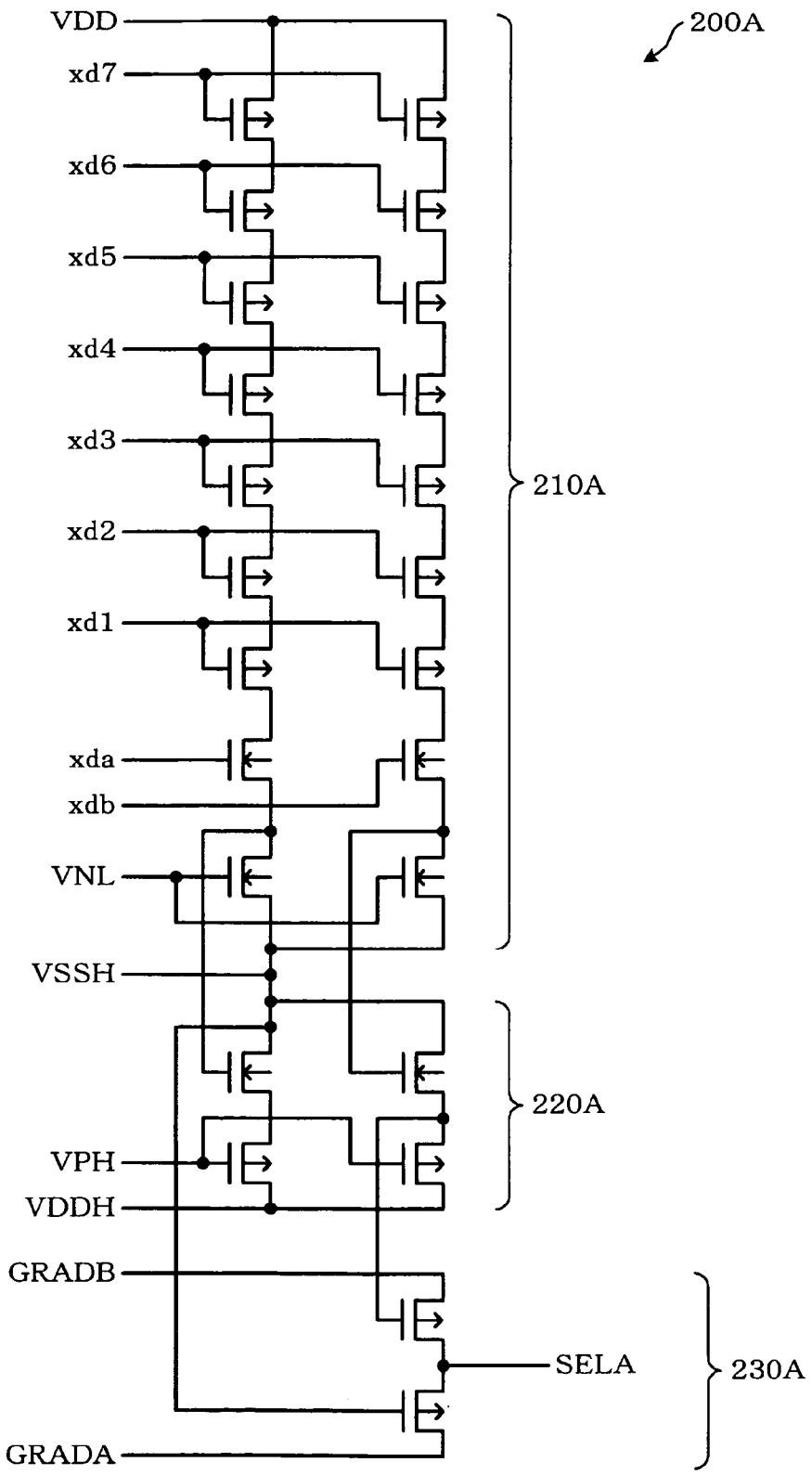
FIG. 19 is a circuit diagram showing a configuration example of the voltage select block shown in FIG. 18.

FIG. 19 is a circuit diagram showing a configuration example of the voltage select block shown in FIG. 18.

The decoder 210A includes two decoder circuits, each of which includes eight p-type (first conductivity type) metal oxide semiconductor (MOS) transistors connected in series. The voltage VDD is supplied to one end of each decoder circuit. An n-type (second conductivity type) MOS transistor is connected to the other end of each decoder circuit. The inversion data xd7 to xd1 and xda is supplied to the gates of the p-type MOS transistors of one of the decoder circuits, and the voltage VNL is supplied to the gate of the n-type MOS transistor. The inversion data xd7 to xd1 and xdb is supplied to the gates of the p-type MOS transistors of the other decoder circuit, and the voltage VNL is supplied to the gate of the n-type MOS transistor.

The voltage VNL is higher than the threshold voltage of the n-type MOS transistor. A drain current of the n-type MOS transistor is generated by applying the voltage VNL so that a constant current is generated between the source and the drain of each p-type MOS transistor connected in series when the inversion data xd7 to xd1 and xda is set at the L level or the inversion data xd7 to xd1 and xdb is set at the L level, whereby a signal set at the H level can be output to the level shifter 220A.

The level shifter 220A is two-element level shifter. The level shifter 220A includes a p-type MOS transistor to which the voltage VPH is supplied at the gate. The voltage VPH is lower in potential than the voltage VDD by at least the threshold voltage of the p-type MOS transistor. The voltage VPH is set so that a drain current (constant current) occurs in the p-type MOS transistor. Therefore, the output of the level shifter 220A can be set at the H level when the n-type MOS transistor of the level shifter 220A is turned ON, and can be set at the L level when the n-type MOS transistor is turned OFF.

The selector 230A outputs the voltage GRADA or GRADB as the voltage SELA based on the output from the level shifter 220A.

1.2.3 Second DAC

Figure 20:
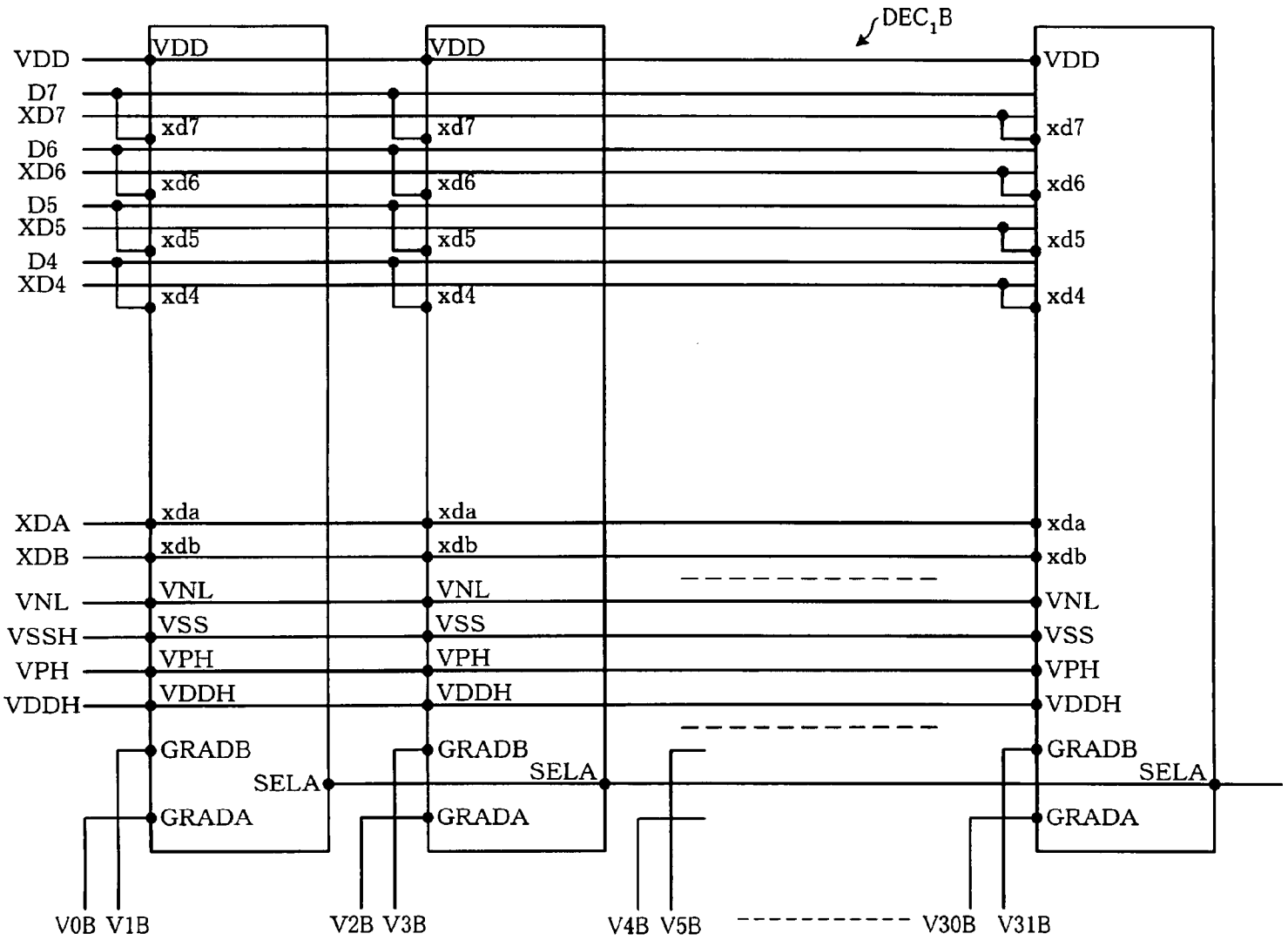
FIG. 20 is a block diagram showing a configuration example of a voltage select circuit of a second DAC shown in FIG. 9, 12, or 13.

FIG. 20 is a block diagram showing a configuration example of the voltage select circuit $DEC_1B$ of the second DAC 58B shown in FIG. 9, 12, or 13.

FIG. 20 shows a configuration example of the voltage select circuit $DEC_1B$ among the voltage select circuits $DEC_1B$ to $DEC_NB$. Note that the voltage select circuits $DEC_2B$ to $DEC_NB$ have the same configuration as that of the voltage select circuit $DEC_1B$.

The voltage select circuit $DEC_1B$ has a plurality of voltage select blocks (16 voltage select blocks). Each voltage select block shown in FIG. 20 has an identical configuration. The voltages VDD, VNL, VSSH, VPH, and VDDH, the data D7 to D4, and the inversion data XD7 to XD4, XDA, and XDB are input to the voltage select blocks. The inversion data XD7 to XD4 is data obtained by reversing the four-bit data D7 to D4 of the higher-order five bits of the grayscale data excluding the least significant bit. The inversion data XDA is set at the H level when the least significant bit data D3 of the higher-order five bits of the grayscale data is "1". The inversion data XDB is set at the H level when the least significant bit data D3 of the higher-order five bits of the grayscale data is "0".

For example, the data D7 to D4 is input to the voltage select block which selects one voltage from the grayscale voltages V0B and V1B, the data D7 to D5 and the inversion data XD4 are input to the voltage select block which selects one voltage from the grayscale voltages V2B and V3B, and the inversion data XD7 to XD4 is input to the voltage select block which selects one voltage from the grayscale voltages V30B and V31B.

Two adjacent grayscale voltages among the grayscale voltages V0B to V31B are sequentially input to each voltage select block. Each voltage select block outputs a voltage SELA from the two grayscale voltages.

Figure 21:
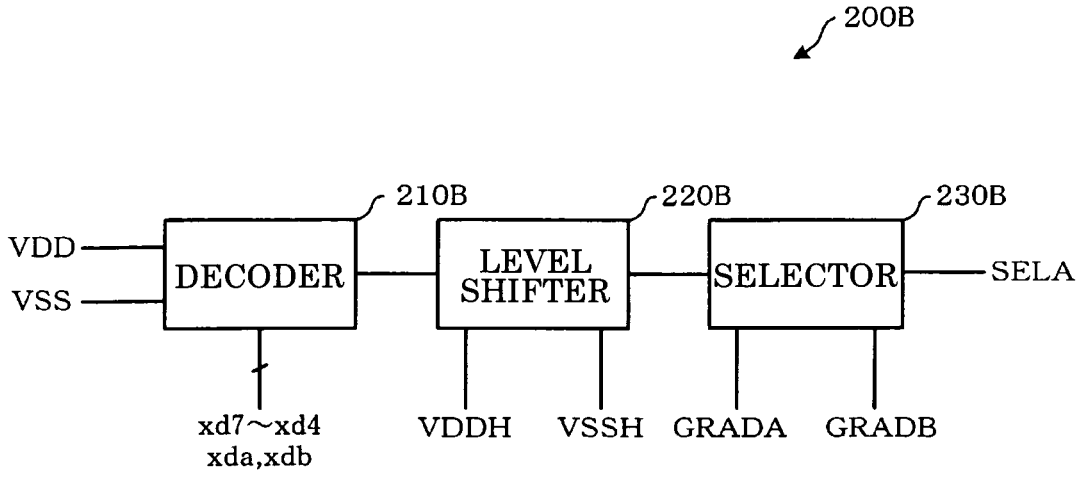
FIG. 21 is a view showing an outline of the configuration of the voltage select block shown in FIG. 20.

FIG. 21 shows an outline of the configuration of the voltage select block shown in FIG. 20.

A voltage select block 200B includes a decoder 210B, a level shifter 220B, and a selector 230B. The decoder 210B generates a switch control signal based on inversion data xd7 to xd4, xda, and xdb. The level shifter 220B converts the switch control signal into a voltage level between the voltages VDDH and VSSH. The selector 230B outputs the voltage SELA from voltages GRADA and GRADB based on the switch control signal converted by the level shifter 220B.

Figure 22:
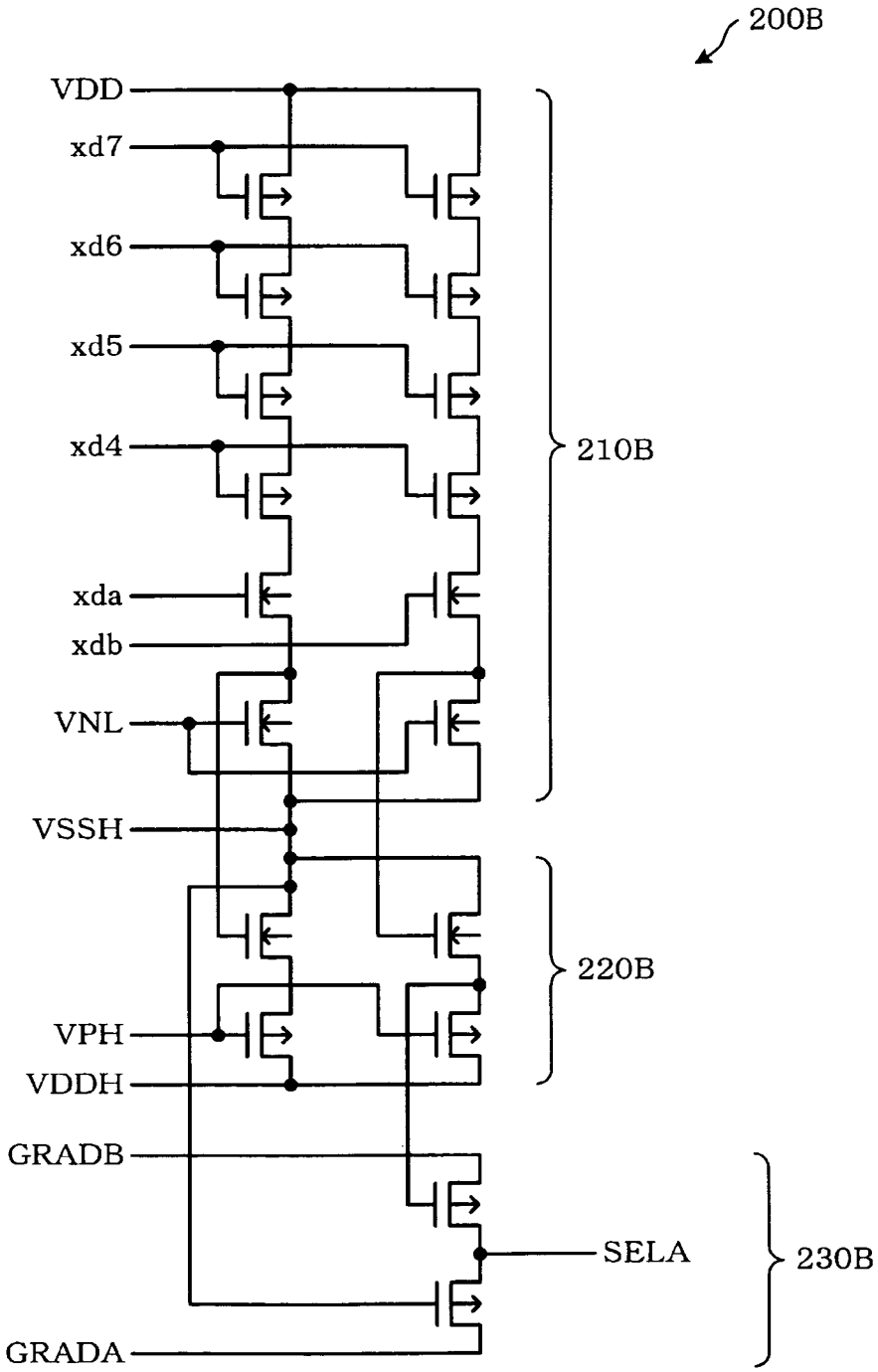
FIG. 22 is a circuit diagram showing a configuration example of the voltage select block shown in FIG. 21.

FIG. 22 is a circuit diagram showing a configuration example of the voltage select block shown in FIG. 21.

The decoder 210B includes two decoder circuits, each of which includes eight p-type MOS transistors connected in series. The voltage VDD is supplied to one end of each decoder circuit. An n-type MOS transistor is connected to the other end of each decoder circuit. The inversion data xd7 to xd4 and xda are supplied to the gates of the p-type MOS transistors of one decoder circuit, and the voltage VNL is supplied to the gate of the n-type MOS transistor. The inversion data xd7 to xd4 and xdb are supplied to the gates of the p-type MOS transistors of the other decoder circuit, and the voltage VNL is supplied to the gate of the n-type MOS transistor.

The voltage VNL is higher than the threshold voltage of the n-type MOS transistor. A drain current of the n-type MOS transistor is generated by applying the voltage VNL so that a constant current is generated between the source and the drain of each p-type MOS transistor connected to series when the inversion data xd7 to xd4 and xda is set at the L level or the inversion data xd7 to xd4 and xdb is set at the L level, whereby a signal set at the H level can be output to the level shifter 220B.

The level shifter 220B is two-element level shifter. The level shifter 220B includes a p-type MOS transistor to which the voltage VPH is supplied at the gate. The voltage VPH is lower in potential than the voltage VDD by at least the threshold voltage of the p-type MOS transistor. The voltage VPH is set so that a drain current (constant current) occurs in the p-type MOS transistor. Therefore, the output of the level shifter 220B can be set at the H level when the n-type MOS transistor of the level shifter 220B is turned ON, and can be set at the L level when the n-type MOS transistor is turned OFF.

The selector 230B outputs the voltage GRADA or GRADB as the voltage SELA based on the output from the level shifter 220B.

When comparing the selector 230A shown in FIG. 19 with the selector 230B shown in FIG. 22, the size of the transistor which forms the selector 230B shown in FIG. 22 can be reduced as compared with the transistor which forms the selector 230A shown in FIG. 19. Specifically, since the number of switch signal lines is smaller than the number of grayscale signal lines, the entire layout area increases to only a small extent even if the size of the selector 230B increases. Therefore, the capability of the second DAC 58B shown in FIGS. 20 to 22 to drive each switch signal line can be increased as compared with the capability of the first DAC 58A shown in FIGS. 17 to 19 to drive each grayscale signal line. This enables the potential of the switch signal line to be set quickly without increasing the layout area to a large extent.

1.2.4 Operational Amplifier

The configuration of the operational amplifier $AMP_1$ according to this embodiment as a buffer circuit is described below.

Figure 23:
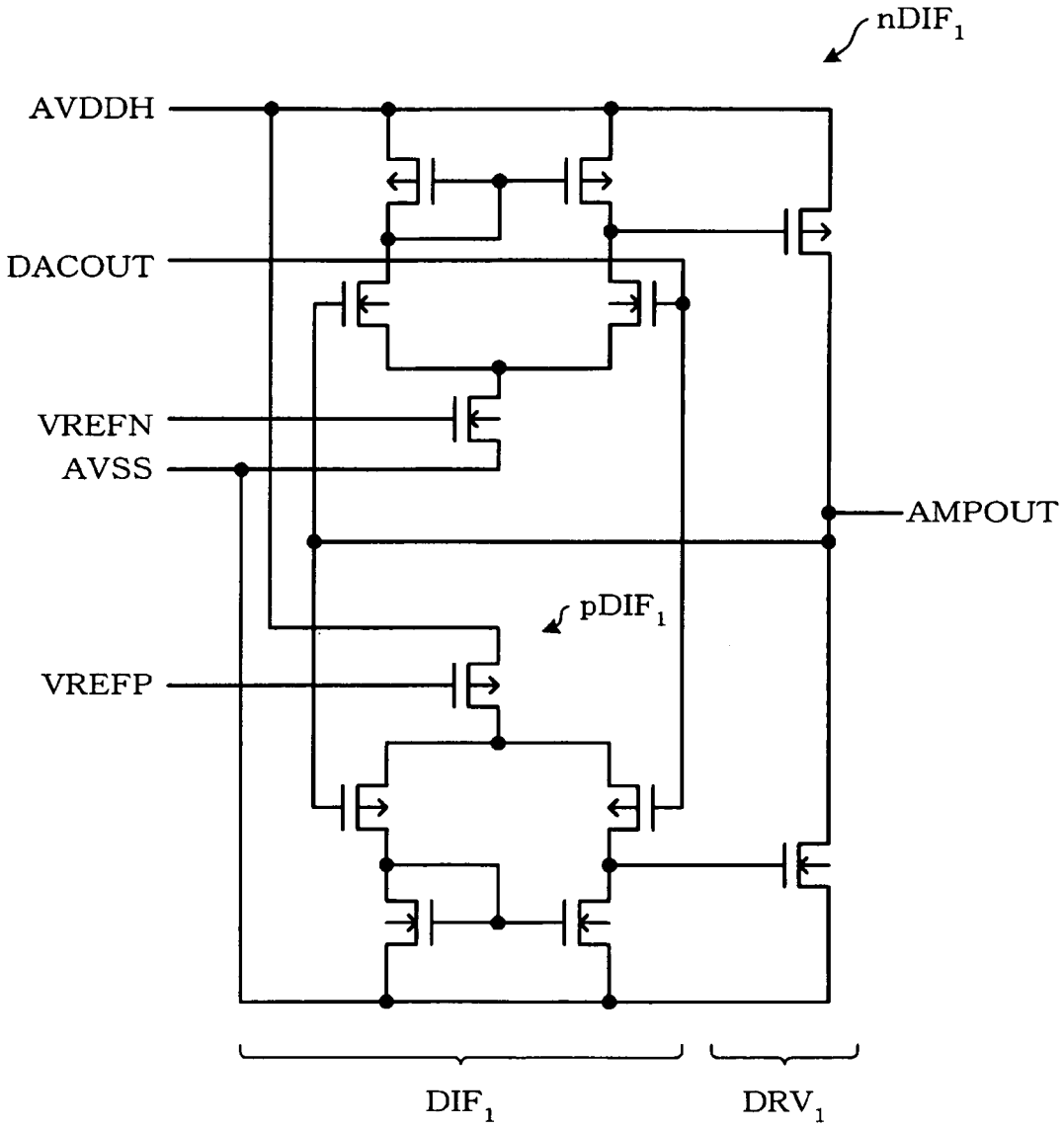
FIG. 23 is a circuit diagram showing a configuration example of a voltage-follower-connected operational amplifier shown in FIG. 9 or 12.

FIG. 23 is a circuit diagram showing a configuration example of the voltage-follower-connected operational amplifier $AMP_1$ shown in FIG. 9 or 12.

FIG. 23 shows a configuration example of the operational amplifier $AMP_1$ of the output circuit $OUT_1$. Note that the operational amplifiers of the output circuits $OUT_2$ to $OUT_N$ have the same configuration as that of the operational amplifier $AMP_1$.

The operational amplifier $AMP_1$ includes a differential section $DIF_1$ and a driver section $DRV_1$. The differential section $DIF_1$ includes first and second differential amplifiers $pDIF_1$ and $nDIF_1$. Each differential amplifier includes a differential transistor pair.

The differential transistor pair of the first differential amplifier $pDIF_1$ is formed using p-type MOS transistors. A current source transistor to which a reference voltage VREFP is supplied at the gate is connected to the sources of the differential transistor pair. A current-mirror circuit formed using n-type MOS transistors is connected to the gate of each MOS transistor of the differential transistor pair. The DAC output voltage DACOUT which is the output voltage from the first DAC 58A or the second DAC 58B is supplied to the gate of one of the MOS transistors of the differential transistor pair, and the output voltage from the differential amplifier $AMP_1$ is supplied to the gate of the other MOS transistor.

The differential transistor pair of the second differential amplifier $nDIF_1$ is formed using n-type MOS transistors. A current source transistor to which a reference voltage VREFN is supplied at the gate is connected to the sources of the differential transistor pair. A current-mirror circuit formed using p-type MOS transistors is connected to the gate of each MOS transistor of the differential transistor pair. The DAC output voltage DACOUT which is the output voltage from the first DAC 58A or the second DAC 58B is supplied to the gate of one of the MOS transistors of the differential transistor pair, and the output voltage from the differential amplifier $AMP_1$ is supplied to the gate of the other MOS transistor.

The driver section $DRV_1$ includes a p-type driver transistor and an n-type driver transistor provided in series between the high-potential-side power supply voltage AVDDH and the low-potential-side power supply voltage AVSS. The output voltage from the second differential amplifier $nDIF_1$ is supplied to the gate of the p-type driver transistor. The output voltage from the first differential amplifier $pDIF_1$ is supplied to the gate of the n-type driver transistor.

1.2.5 Operation

An operation according to this embodiment is described below.

An operation in a comparative example according to this embodiment is described below before describing the operation according to this embodiment. In this comparative example, the source line is driven based on a voltage selected by the first DAC 58A at a grayscale voltage switch timing.

Figure 24:
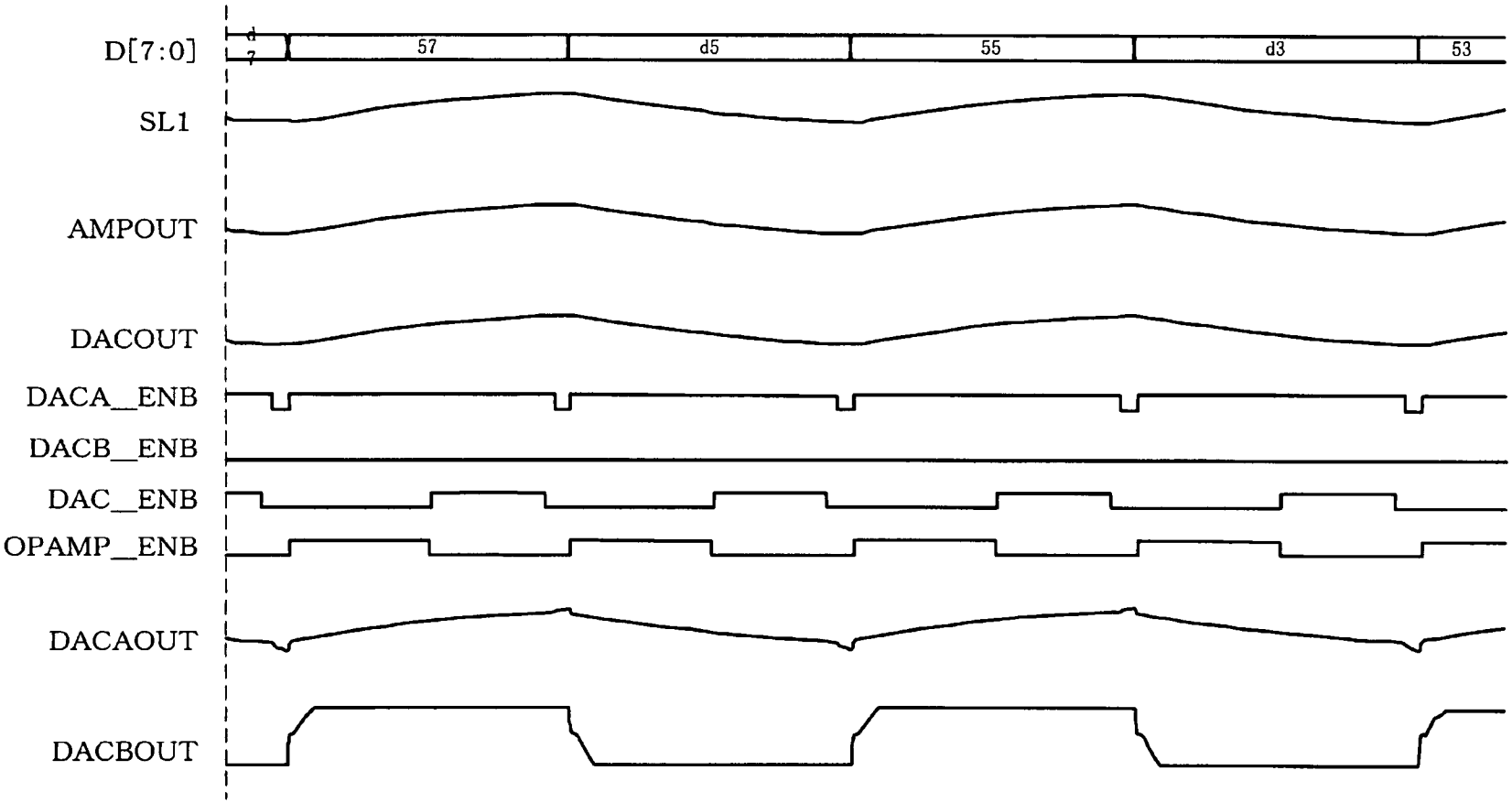
FIG. 24 is a timing diagram showing a timing example of an operation according to a comparative example of one embodiment of the invention.

FIG. 24 is a timing diagram showing an example of an operation according to a comparative example of this embodiment.

In FIG. 24, the grayscale data D[7:0] is changed each time one horizontal scan period expires. FIG. 24 shows a change in the potential level of the source line SL1, a change in the potential level of the output voltage of the operational amplifier $AMP_1$, a change in the potential level of the DAC output voltage DACOUT, a change in the potential level of the control signals DACA_ENB, DACB_ENB, DAC_ENB, and OPAMP_ENB and the output voltage DACAOUT from the first DAC 58A, and a change in the potential level of the output voltage DACBOUT from the second DAC 58B.

In FIG. 24, the operation according to this comparative example is implemented by always setting the control signal DACB_ENB at the L level for comparison with this embodiment.

As shown in FIG. 24, the next horizontal scan period starts before the potential level of the DAC output voltage DACOUT is stabilized at a desired potential level within one horizontal scan period. Therefore, the output voltage from the operational amplifier $AMP_1$ and the voltage of the source line $SL_1$ change to a large extent.

Figure 25:
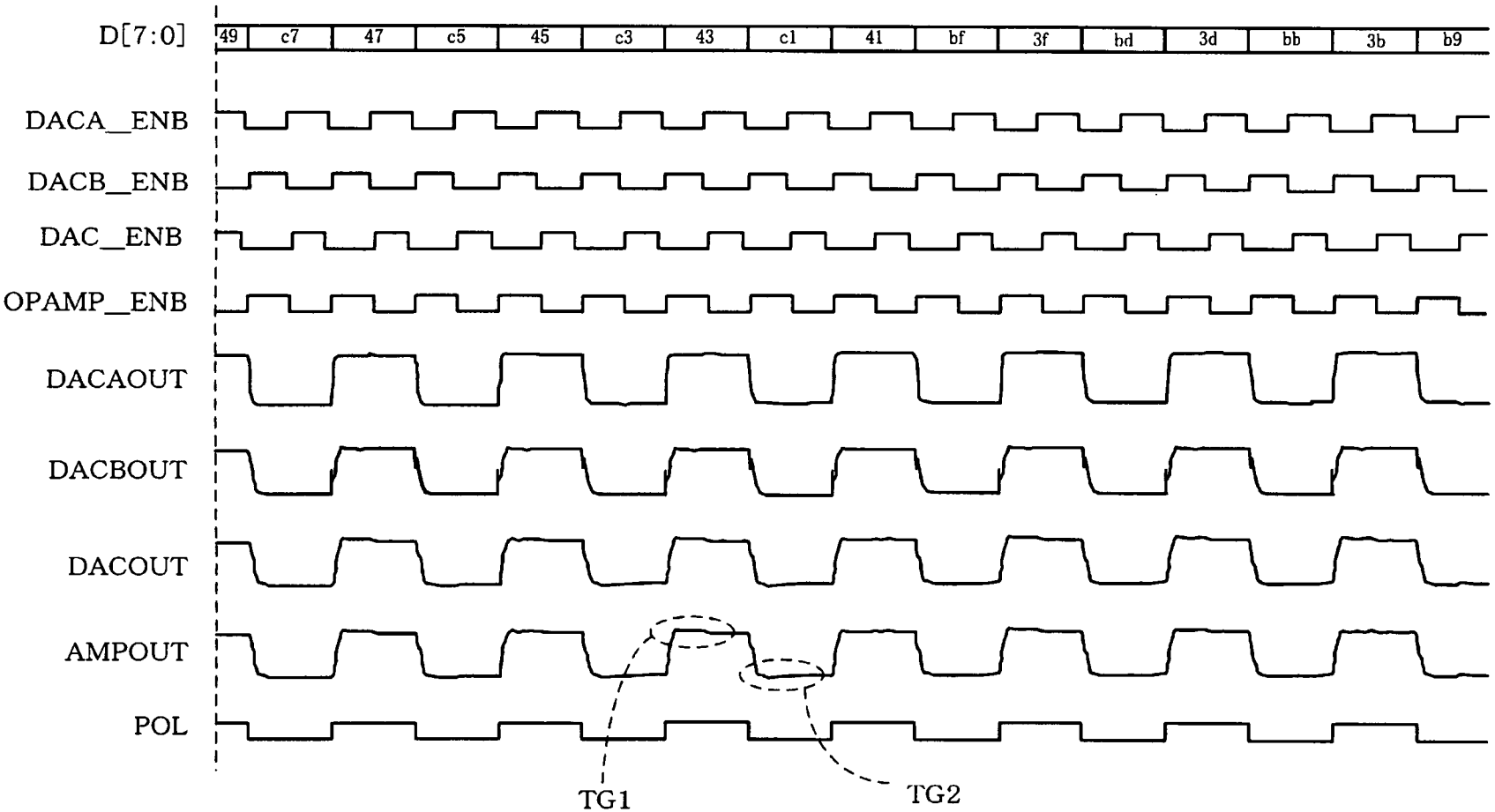
FIG. 25 is a timing diagram showing an example of an operation according to one embodiment of the invention.

FIG. 25 is a timing diagram showing an example of an operation according to this embodiment.

In FIG. 25, the grayscale data D[7:0] is changed each time one horizontal scan period expires in the same manner as in FIG. 24. FIG. 25 shows a change in the potential level of the control signals DACA_ENB, DACB_ENB, DAC_ENB, and OPAMP_ENB and the output voltage DACAOUT from the first DAC 58A, a change in the potential level of and a change in the potential level of the output voltage DACBOUT from the second DAC 58B, a change in the potential level of the DAC output voltage DACOUT, and a change in the potential level of the output voltage of the operational amplifier $AMP_1$.

In FIG. 25, the voltage is changed from the voltage of the switch signal line to the voltage of the grayscale signal line in a period TG1 when the polarity inversion signal POL is set at the H level. The voltage is changed from the voltage of the switch signal line to the voltage of the grayscale signal line in a period TG2 when the polarity inversion signal POL is set at the L level. In FIG. 25, the potential level of the DAC output voltage DACOUT is stabilized at a desired potential level within one horizontal scan period. Therefore, a change in the output voltage from the operational amplifier $AMP_1$ and the voltage of the source line $SL_1$ is eliminated, whereby high grayscale accuracy can be achieved.

Figure 26:
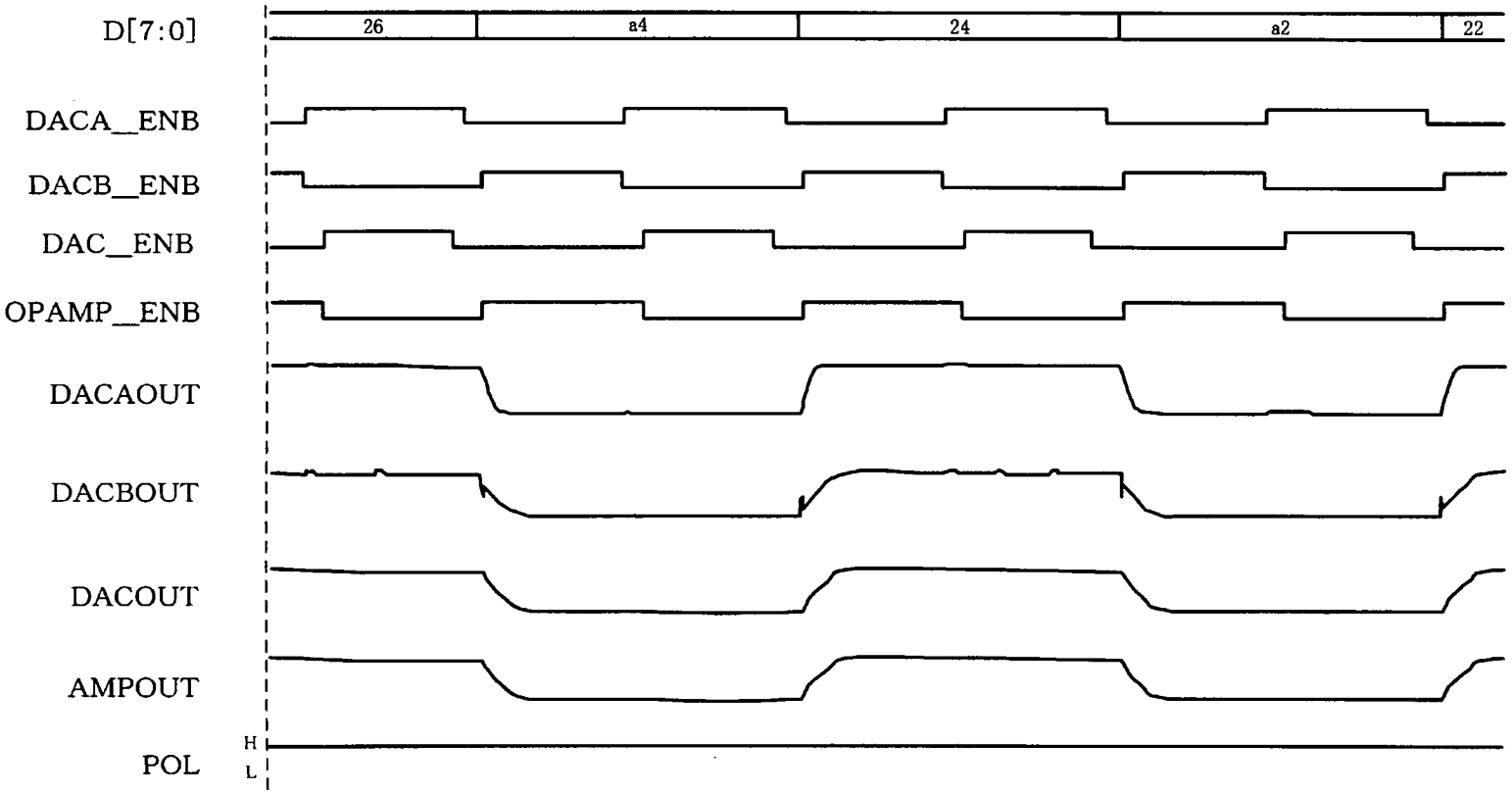
FIG. 26 is a timing diagram showing an example of an operation according to one embodiment of the invention when a polarity inversion signal is fixed at an H level.

FIG. 26 is a timing diagram showing an example of an operation according to this embodiment when the polarity inversion signal POL is fixed at the H level.

Figure 27:
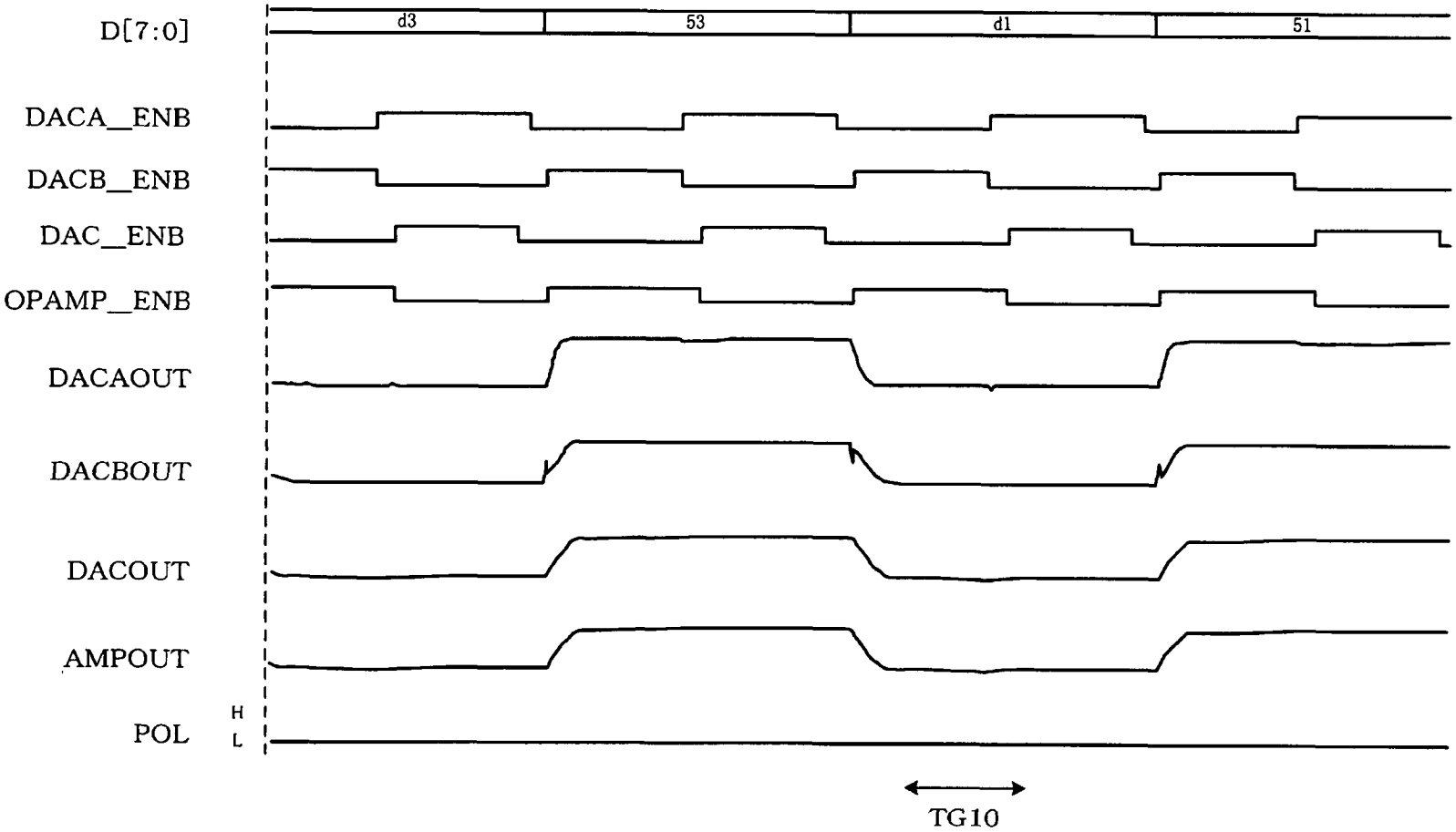
FIG. 27 is a timing diagram showing an example of an operation according to one embodiment of the invention when a polarity inversion signal is fixed at an L level.

FIG. 27 is a timing diagram showing an example of an operation according to this embodiment when the polarity inversion signal POL is fixed at the L level.

As shown in FIG. 27, the voltage changes to the potential level of the voltage of the switch signal line set at a low potential side and then returns to the potential level of the voltage of the grayscale signal line in a period TG10 in FIG. 27.

Figure 28:
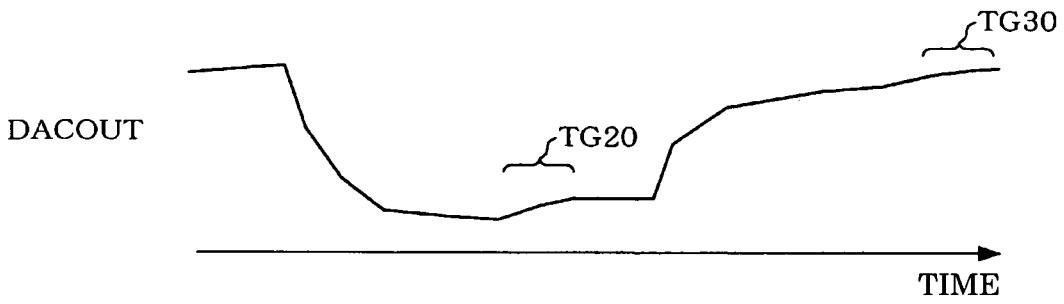
FIG. 28 is a view schematically showing the waveform of a DAC output voltage shown in FIG. 27.

FIG. 28 schematically shows the waveform of the DAC output voltage DACOUT in the period TG10 shown in FIG. 27.

As shown in FIG. 28, the DAC output voltage DACOUT changes to the potential level of the voltage of the switch signal line set to a low potential side in a period TG20. Thereafter, the DAC output voltage DACOUT changes to the voltage of the grayscale signal line and then changes to the desired potential level.

According to this embodiment, a source driver can be provided which can achieve high grayscale accuracy with an increased number of grayscales when polarity inversion drive is performed.

Figure 29:
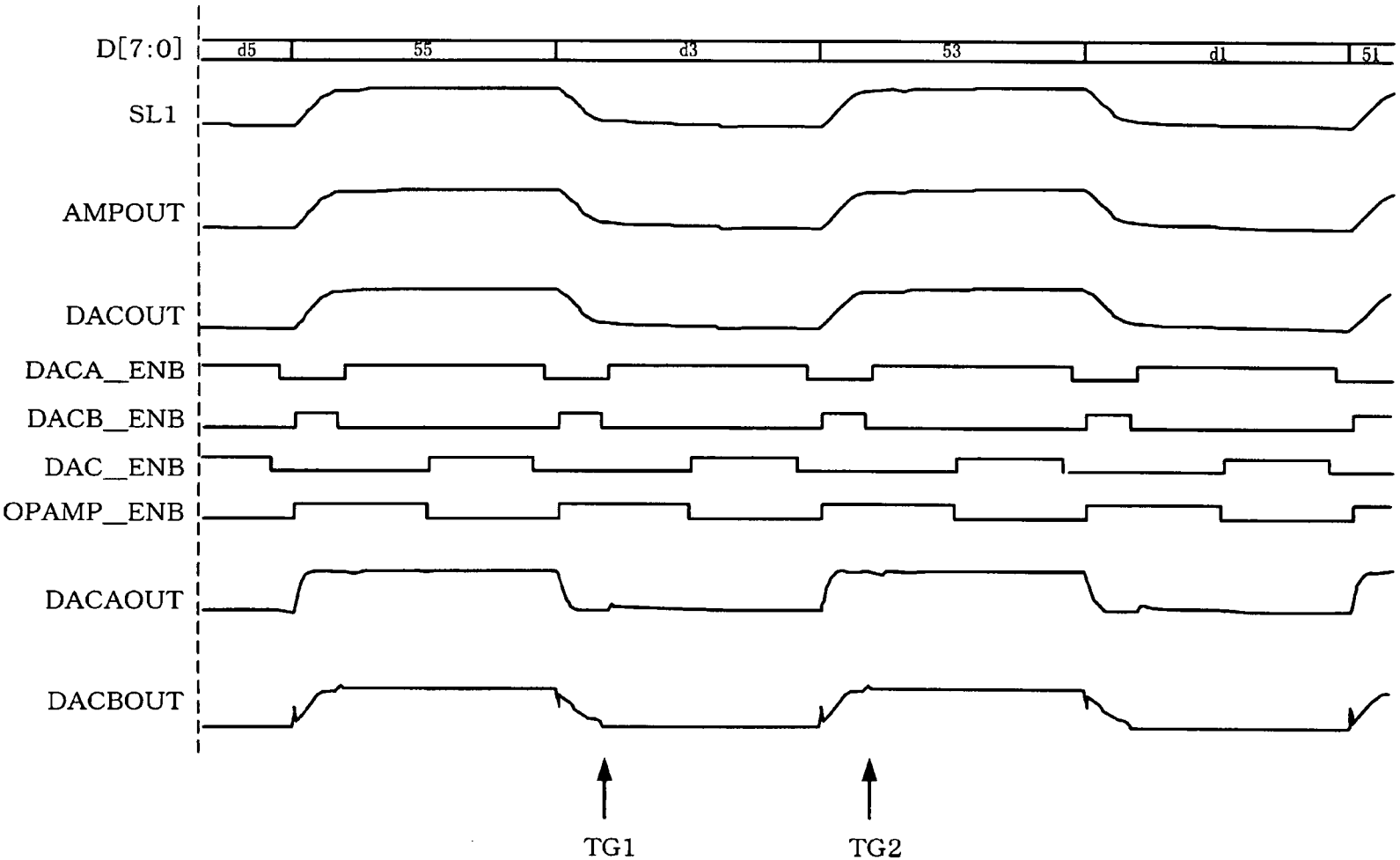
FIG. 29 is a timing diagram showing another example of an operation according to one embodiment of the invention.

FIG. 29 is a timing diagram showing another example of an operation according to this embodiment.

In FIG. 29, the grayscale data D[7:0] is changed each time one horizontal scan period expires in the same manner as in FIG. 24. FIG. 29 shows a change in the potential level of the source line SL1, a change in the potential level of the output voltage of the operational amplifier $AMP_1$, a change in the potential level of the DAC output voltage DACOUT, a change in the potential level of the control signals DACA_ENB, DACB_ENB, DAC_ENB, and OPAMP_ENB and the output voltage DACAOUT from the first DAC 58A, and a change in the potential level of the output voltage DACBOUT from the second DAC 58B.

In FIG. 29, the voltage changes from the output from the second DAC 58B to the output from the first DAC 58A at timings TG1 and TG2, whereby the potential level of the DAC output voltage DACOUT is stabilized at a desired potential level within one horizontal scan period, although the conditions are the same as in FIG. 24. Therefore, a change in the output voltage from the operational amplifier $AMP_1$ and the voltage of the source line $SL_1$ is eliminated, whereby high grayscale accuracy can be achieved.

2. Electronic Instrument

An electronic instrument to which the liquid crystal device 10 (source driver 30) according to the above embodiment is applied is described below.

2.1 Projection-Type Display Device

An electronic instrument formed using the above-described liquid crystal device 10 may be a projection-type display device.

Figure 30:
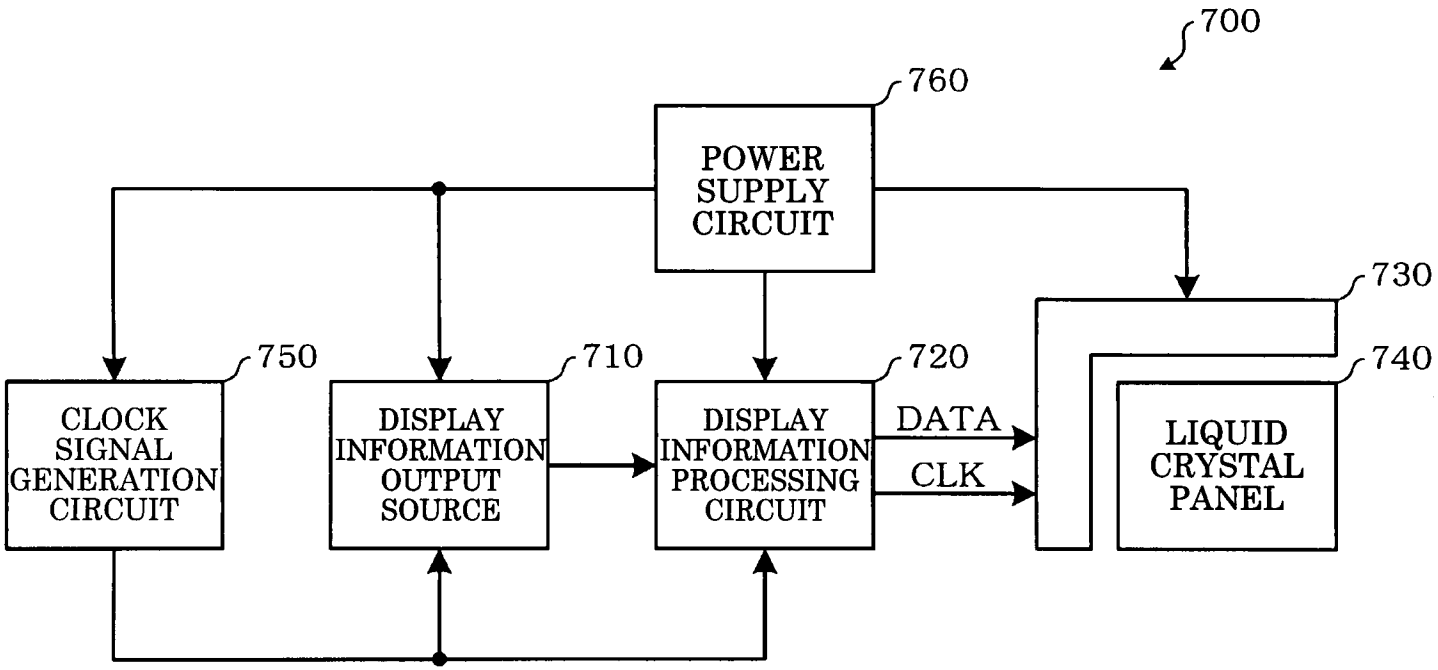
FIG. 30 is a block diagram showing a configuration example of a projection-type display device according to one embodiment of the invention.

FIG. 30 is a block diagram showing a configuration example of a projection-type display device to which the liquid crystal device 10 according to the above embodiment is applied.

A projection-type display device 700 includes a display information output source 710, a display information processing circuit 720, a display driver circuit 730 (display driver), a liquid crystal panel 740, a clock signal generation circuit 750, and a power supply circuit 760. The display information output source 710 includes a memory such as a read only memory (ROM), a random access memory (RAM), or an optical disk device, and a tuning circuit which tunes and outputs an image signal. The display information output source 710 outputs display information (e.g., image signal in a given format) to the display information processing circuit 720 based on a clock signal from the clock signal generation circuit 750. The display information processing circuit 720 may include an amplification/polarity inversion circuit, a phase expansion circuit, a rotation circuit, a gamma correction circuit, a clamping circuit, or the like. The display driver circuit 730 includes a gate driver and a source driver, and drives the liquid crystal panel 740. The power supply circuit 760 supplies power to each circuit.

Figure 31:
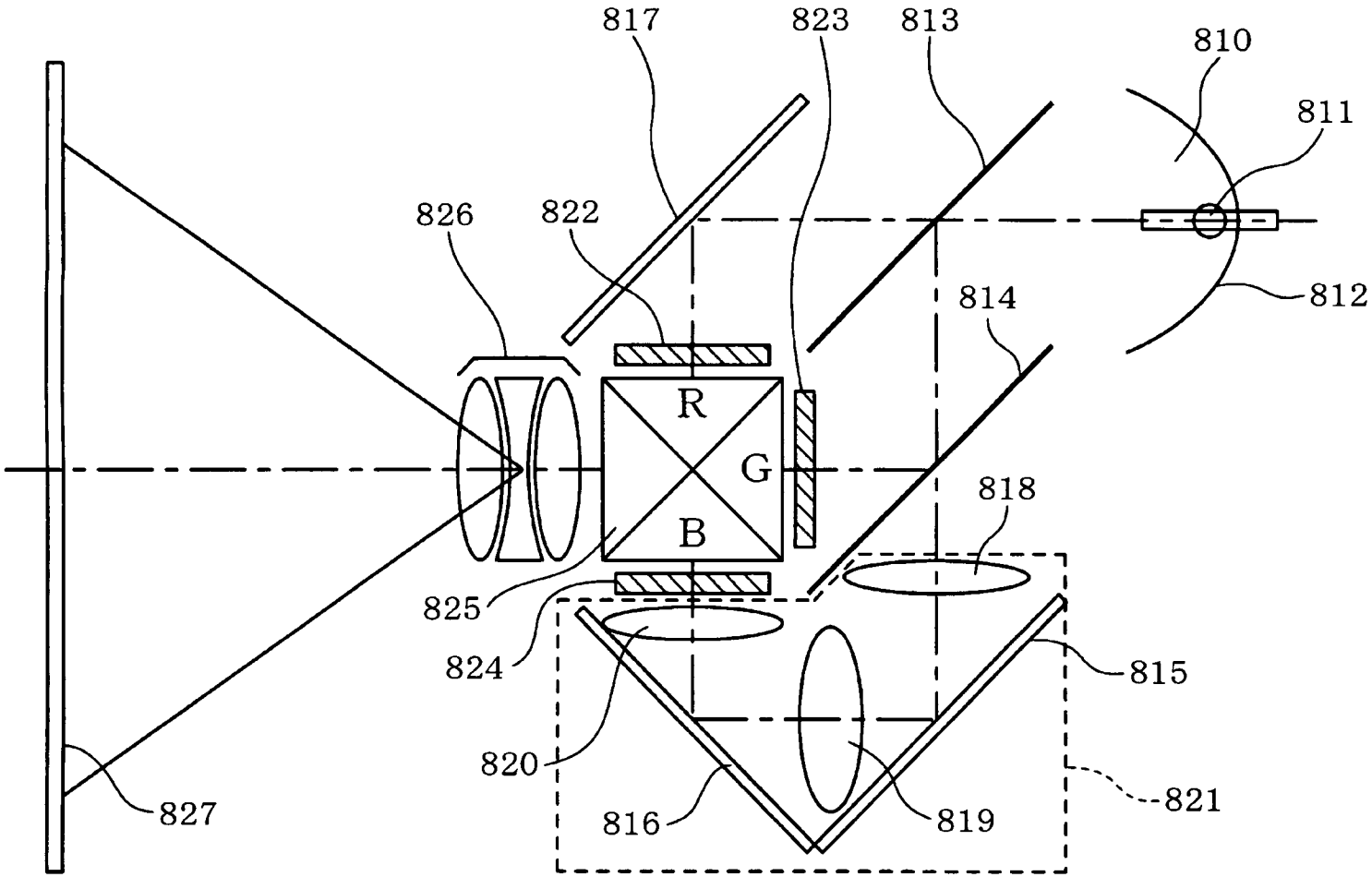
FIG. 31 is a schematic view showing the main portion of a projection-type display device.

FIG. 31 is a schematic view showing the main portion of a projection-type display device.

The projection-type display device includes a light source 810, dichroic mirrors 813 and 814, reflection mirrors 815, 816, and 817, an incident lens 818, a relay lens 819, an exit lens 820, liquid crystal light modulators 822, 823, and 824, a cross dichroic prism 825, and a projection lens 826. The light source 810 includes a lamp 811 such as a metal halide lamp, and a reflector 812 which reflects light emitted from the lamp. The dichroic mirror 813 which reflects blue light and green light allows red light contained in luminous flux from the light source 810 to pass through, and reflects blue light and green light. Red light which has passed through the dichroic mirror 813 is reflected by the reflection mirror 817 and enters the red light liquid crystal light modulator 822. Green light reflected by the dichroic mirror 813 is reflected by the dichroic mirror 814 which reflects green light, and enters the green light liquid crystal light modulator 823. Blue light also passes through the second dichroic mirror 814. A photo-conductive means 821 formed of a relay lens system including the incident lens 818, the relay lens 819, and the exit lens 820 is provided for blue light in order to prevent optical loss due to a long optical path. Blue light enters the blue light liquid crystal light modulator 824 through the photo-conductive means 821. The three color light rays modulated by each light modulator circuit enters the cross dichroic prism 825. In the cross dichroic prism 825, four rectangular prisms are bonded, and a dielectric multilayer film which reflects red light and a dielectric multilayer film which reflects blue light are formed on the inner side in the shape of a cross. The three color light rays are synthesized by the dielectric multilayer films so that light which expresses a color image is formed. The projection means of the projection-type display device is thus formed. Light synthesized by the projection means is projected onto a screen 827 by a projection lens 826 (projection optical system) so that an enlarged image is displayed.

2.2 Portable Telephone

An electronic instrument formed using the above-described liquid crystal device 10 may be a portable telephone.

Figure 32:
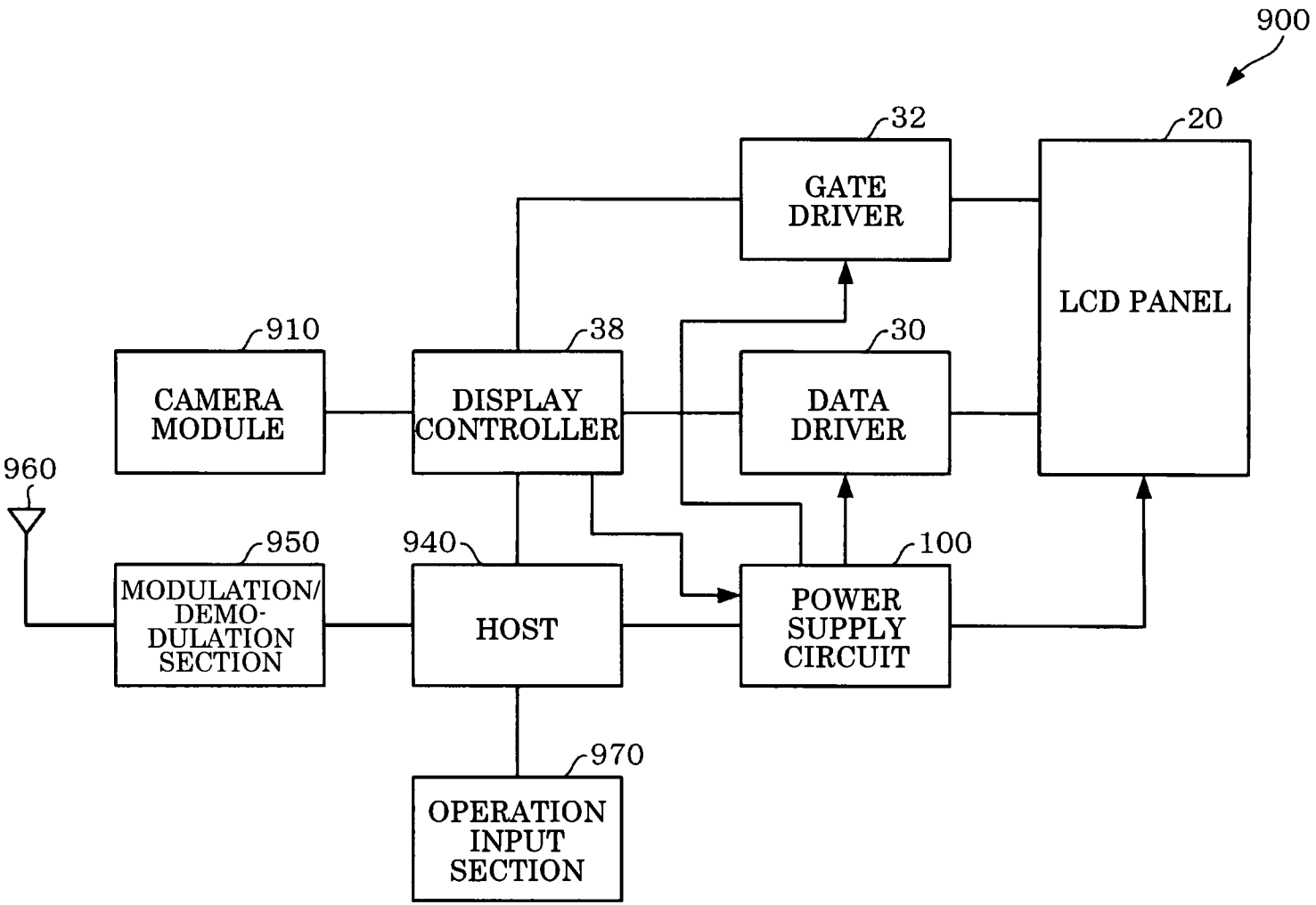
FIG. 32 is a block diagram of a configuration example of a portable telephone according to one embodiment of the invention.

FIG. 32 is a block diagram showing a configuration example of a portable telephone to which the liquid crystal device 10 according to the above embodiment is applied. In FIG. 32, the same sections as in FIG. 1 or 2 are indicated by the same symbols. Description of these sections is appropriately omitted.

A portable telephone 900 includes a camera module 910. The camera module 910 includes a CCD camera, and supplies data of an image captured using the CCD camera to the display controller 38 in a YUV format.

The portable telephone 900 includes the LCD panel 20. The LCD panel 20 is driven by the source driver 30 and the gate driver 32. The LCD panel 20 includes gate lines, source lines, and pixels.

The display controller 38 is connected with the source driver 30 and the gate driver 32, and supplies grayscale data in an RGB format to the source driver 30.

The power supply circuit 100 is connected with the source driver 30 and the gate driver 32, and supplies drive power supply voltages to the source driver 30 and the gate driver 32. The power supply circuit 100 supplies the common electrode voltage Vcom to the common electrode of the LCD panel 20.

A host 940 is connected with the display controller 38. The host 940 controls the display controller 38. The host 940 demodulates grayscale data received through an antenna 960 using a modulator-demodulator section 950, and supplies the demodulated grayscale data to the display controller 38. The display controller 38 causes the source driver 30 and the gate driver 32 to display an image on the LCD panel 20 based on the grayscale data.

The host 940 modulates grayscale data generated by the camera module 910 using the modulator-demodulator section 950, and directs transmission of the modulated data to another communication device via the antenna 960.

The host 940 transmits and receives grayscale data, captures an image using the camera module 910, and displays an image on the LCD panel 20 based on operation information from an operation input section 970.

In FIG. 32, the host 940 or the display controller 38 may be referred to as a means that supplies grayscale data.

The invention is not limited to the above embodiments. Various modifications and variations may be made within the spirit and scope of the invention. For example, the invention may be applied not only to drive the above liquid crystal display panel, but also to drive an electroluminescent display device, a plasma display device, and the like.

Some of the requirements of any claim of the invention may be omitted from a dependent claim which depends on that claim. Some of the requirements of any independent claim of the invention may be allowed to depend on any other independent claim.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. A source driver that drives a source line of an electro-optical device based on grayscale data, the source driver comprising:

P grayscale signal lines, P being a positive integer equal to or larger than two, a corresponding grayscale voltage being supplied to each of the P grayscale signal lines;

Q switch signal lines, Q being a positive integer equal to or smaller than P, a corresponding grayscale voltage being supplied to each of the Q switch signal lines;

a first DAC that outputs a grayscale voltage among P grayscale voltages that are supplied to the P grayscale signal lines based on the grayscale data;

a second DAC that outputs a grayscale voltage among Q grayscale voltages that are supplied to the Q switch signal lines based on the grayscale data; and a source line driver section that drives the source line based on an output from the first DAC or the second DAC, the source line driver section generating a second drive signal of the source line based on the output from the second DAC, and then generating a first drive signal of the source line based on the output from the first DAC within one horizontal scan period.

2. The source driver as defined in claim 1, further comprising:

a switch voltage select circuit that outputs the Q grayscale voltages among at least (Q+1) grayscale voltages based on a polarity of a voltage applied to an electro-optical substance, a voltage of the source line being applied to the electro-optical substance.

3. The source driver as defined in claim 2, the polarity being a polarity of a voltage applied to the electro-optical substance that is sealed between a pixel electrode that is provided with the voltage of the source line and a common electrode that is provided opposite to the pixel electrode.

4. The source driver as defined in claim 2, when the switch voltage select circuit outputs the Q grayscale voltages from the (Q+1) grayscale voltages, the switch voltage select circuit outputting the Q grayscale voltages among the (Q+1) grayscale voltages excluding a grayscale voltage at the lowest potential when the polarity is positive.

5. The source driver as defined in claim 2, when the switch voltage select circuit outputs the Q grayscale voltages from the (Q+1) grayscale voltages, the switch voltage select circuit outputting the Q grayscale voltages among the (Q+1) grayscale voltages excluding a grayscale voltage at the highest potential when the polarity is negative.

6. The source driver as defined in claim 1, the source line driver section including an output buffer that drives the source line based on the output from the first DAC or the second DAC; and the source line driver section driving the source line using the output buffer in a buffer output period within the one the horizontal scan period, and supplying an input voltage of the output buffer to the source line in a DAC output period after the buffer output period.

7. The source driver as defined in claim 6, the buffer output period overlapping a period when the source line driver section drives the source line based on the output from the second DAC.

8. The source driver as defined in claim 6, the DAC output period starts after a start timing of a period when the source line driver section drives the source line based on the output from the first DAC.

9. The source driver as defined in claim 1, when impedance of a switch signal line among the Q switch signal lines in a period $t_B$ when the source line driver circuit drives the source line based on the output from the second DAC is referred to as $Z_B$, and the impedance of a grayscale signal line among the P grayscale signal lines in a period $t_A$ when the source line driver circuit drives the source line based on the output from the first DAC is referred to as $Z_A$, $t_A/t_B$ being equal to $Z_A/Z_B$.

10. The source driver as defined in claim 1,

P being $2^K$, K being an integer equal to or larger than two, and Q being $2^{K-L}$, L being a natural number smaller than K.

11. The source driver as defined in claim 1, further comprising:

a grayscale voltage generation circuit that generates a plurality of grayscale voltages, the plurality of grayscale voltages being obtained by dividing a voltage between given two voltages using resistors, a corresponding grayscale voltage among the plurality of grayscale voltages that are generated by the grayscale voltage generation circuit being supplied to each of the P grayscale signal lines; and at least one of the Q switch signal lines being driven by a buffer circuit.

12. An electro-optical device comprising the source driver as defined in claim 1.

13. A projection-type display device comprising the source driver as defined in claim 1.

14. An electronic instrument comprising the source driver as defined in claim 1.

15. A source driver that drives a source line of an electro-optical device based on grayscale data, the source driver comprising:

P grayscale signal lines, P being a positive integer equal to or larger than two, a corresponding grayscale signal being supplied to each of the P grayscale signal lines;

Q switch signal lines, Q being a positive integer equal to or smaller than P, a corresponding grayscale signal being supplied to each of the Q switch signal lines;

a first DAC that outputs a grayscale signal among the P grayscale signals supplied to the P grayscale signal lines based on the grayscale data;

a second DAC that outputs a grayscale signal among the Q grayscale signals supplied to the Q switch signal lines based on the grayscale data; and a source line driver section that drives the source line based on an output from the first DAC or the second DAC, the source line driver section generating a second drive signal of the source line based on the output from the second DAC, and then generating a first drive signal of the source line based on the output from the first DAC within one horizontal scan period.

16. The source driver as defined in claim 15, further comprising:

a switch signal select circuit that outputs the Q grayscale signals among at least (Q+1) grayscale signals based on a polarity of a signal applied to an electro-optical substance, a signal of the source line being applied to the electro-optical substance.

17. An electro-optical device comprising the source driver as defined in claim 15.

18. A projection-type display device comprising the source driver as defined in claim 15.

19. An electronic instrument comprising the source driver as defined in claim 15.

* * * * *